US008794486B2

(12) United States Patent
Wolfinbarger

(10) Patent No.: US 8,794,486 B2
(45) Date of Patent: Aug. 5, 2014

(54) APPARATUS WITH PUMP AND VALVE FOR USE WITH INTERNAL AND EXTERNAL FLUID RESERVOIR

(75) Inventor: Ryan Wolfinbarger, Avon, IN (US)

(73) Assignee: Gigglicious, LLC, Avon, IN (US)

( * ) Notice: Subject to any disclaimer, the term of this patent is extended or adjusted under 35 U.S.C. 154(b) by 106 days.

(21) Appl. No.: 13/438,416

(22) Filed: Apr. 3, 2012

(65) Prior Publication Data

US 2013/0256335 A1 Oct. 3, 2013

(51) Int. Cl.
*F41B 9/00* (2006.01)

(52) U.S. Cl.
USPC ..... 222/79; 446/153

(58) Field of Classification Search
USPC ..... 222/79, 136, 144.5, 145.1, 464.1, 382; 446/153
See application file for complete search history.

(56) References Cited

U.S. PATENT DOCUMENTS

| | | | | | |
|---|---|---|---|---|---|
| 2,527,614 | A | * | 10/1950 | Arpin | 222/79 |
| 2,753,079 | A | * | 7/1956 | Hersey | 222/79 |
| 3,318,482 | A | * | 5/1967 | Voce | 222/79 |
| 3,577,675 | A | | 5/1971 | Kohner et al. | |
| 3,578,789 | A | * | 5/1971 | Ferri | 222/79 |
| 3,674,024 | A | * | 7/1972 | Cirillo | 604/295 |
| 4,412,680 | A | | 11/1983 | Zorn | |
| 5,052,587 | A | * | 10/1991 | Graves | 222/79 |
| 5,322,191 | A | * | 6/1994 | Johnson et al. | 222/79 |
| 5,336,122 | A | | 8/1994 | Lewis | |
| 5,366,108 | A | * | 11/1994 | Darling | 222/1 |
| 5,586,688 | A | * | 12/1996 | Johnson et al. | 222/61 |
| 5,605,253 | A | * | 2/1997 | Luk | 222/79 |
| 5,826,750 | A | | 10/1998 | Johnson | |
| 5,829,635 | A | | 11/1998 | Brovelli | |
| 5,928,053 | A | | 7/1999 | Henderson | |
| 6,892,902 | B2 | * | 5/2005 | Hornsby et al. | 222/79 |
| 6,929,151 | B1 | * | 8/2005 | Clayton | 222/79 |
| 6,964,380 | B1 | * | 11/2005 | Chen | 239/315 |
| 7,036,751 | B1 | | 5/2006 | Lund et al. | |
| 7,281,642 | B2 | | 10/2007 | Orlowski | |
| 7,530,474 | B2 | * | 5/2009 | Amron | 222/79 |
| 7,775,849 | B2 | * | 8/2010 | Wong et al. | 446/153 |
| 7,913,880 | B2 | * | 3/2011 | Chia | 222/386 |
| 8,316,897 | B2 | * | 11/2012 | Lucas | 141/18 |
| 8,469,234 | B1 | * | 6/2013 | Loomis | 222/79 |
| 2004/0155058 | A1 | * | 8/2004 | Dunham et al. | 222/79 |
| 2005/0098577 | A1 | | 5/2005 | Huy et al. | |
| 2010/0170920 | A1 | | 7/2010 | Chia | |

OTHER PUBLICATIONS

Amazon.com, Jabsco 17215-0000 Drill Pump Kit [online], [retrieved on Apr. 3, 2012]. Retrieved from the Internet <URL: http://www.amazon.com/Jabsco-17215-0000-Drill-Pump-Kit/dp/B000O8B10Q/ref=sr_1_1?s=sporting-goods&ie=UTF8&qid=1333457778&sr=1-1> (4 pgs).

(Continued)

*Primary Examiner* — Paul R Durand
*Assistant Examiner* — Donnell Long
(74) *Attorney, Agent, or Firm* — Cooley LLP

(57) ABSTRACT

A toy water gun can include a housing having a first intake port, a second intake port and an outtake port. The housing of the toy water gun (also referred to herein as "water gun") can define an internal chamber. The toy water gun can include a pump configured to transfer fluid from the first intake port to outside of the housing through the outtake port when the pump is activated and when the first intake port is disposed within an external fluid reservoir.

20 Claims, 35 Drawing Sheets

(56) References Cited

OTHER PUBLICATIONS

Amazon.com, Tuthill Transfer SD62 Rotary Vane Hand Pump by Tuthill [online], [retrieved on Apr. 3, 2012]. Retrieved from the Internet <URL: http://www.amazon.com/s/ref=nb_sb_noss?url=search-alias%3Dsporting&field-keywords=Tuthill+Transfer+SD62+Rotaty+Vane+Hand+Pump> (4 pgs).

Amazon.com, Terapump™ Rotary Hand Manual Drum Barrel Pump by Terapump [online], [retrieved on Apr. 3, 2012]. Retrieved from the Internet <URL: <http://www.amazon.com/TERAPUMP-ROTARY-HAND-MANUAL-BARREL/dp/B0026JG7EQ/ref=sr_1_1?ie=UTF8&qid=1333462128&sr=8-1> (4 pgs).

Amazon.com, Magnum Fuel Pump—Hand Crank by Magnum [online], [retrieved on Apr. 3, 2012]. Retrieved from the Internet <URL: http://www.amazon.com/Magnum-Fuel-Pump-Hand-Crank/dp/B0016NBDU6/ref=sr_1_1?ie=UTF8&qid=1333459320&sr=8-1> (4 pgs).

Amazon.com, Hand Pump Kit (093606) by WM Harvey [online], [retrieved on Apr. 3, 2012]. Retrieved from the Internet <URL: http://www.amazon.com/WM-Harvey-093606-Hand-Pump/dp/B000PSBH9U> (4 pgs).

Wikipedia, Peristaltic pump [online], [retrieved on Apr. 3, 2012]. Retrieved from the Internet <URL: http://en.wikipedia.org/wiki/Peristaltic_pump> (7 pgs).

* cited by examiner

APPARATUS WITH PUMP AND VALVE FOR USE WITH INTERNAL AND EXTERNAL FLUID RESERVOIR

BACKGROUND

Some embodiments herein relate generally to toy water guns with a pump and a fluid reservoir.

Known toy water guns are available in various sizes and configurations, and can include various features. Such toy water guns can include various mechanical designs for propelling a liquid through a nozzle. For example, some known toy water guns can include a squeeze bulb, a trigger pump, an air pressurized reservoir, a motorized piston, a peristaltic pump, and/or the like. Often known toy water guns include an internal reservoir and/or a reservoir that is integrally coupled to the toy water gun. In use, the reservoir is filled by an external water source and propelled though a nozzle via a pump mechanism described above. Toy water guns including a peristaltic pump typically dispense of all the water contained in the reservoir quickly and, as such, the user must refill the reservoir to continue to shoot water from the toy gun. Refilling the toy water gun can take time and prevent the user from actively participating in a game, such as a toy water gun fight.

Thus, a need exists for a toy water gun that includes a pump and a valve enabling the use of the toy water gun with an internal reservoir and an external reservoir.

SUMMARY

In some embodiments, a toy water gun includes a housing having a first intake port, a second intake port, and an outtake port. The housing of the toy water gun can define an internal chamber. The toy water gun can include a pump configured to transfer fluid from the first intake port to outside of the housing through the outtake port when the pump is activated and when the first intake port is disposed within an external fluid reservoir.

DETAILED DESCRIPTION

Figure 1:
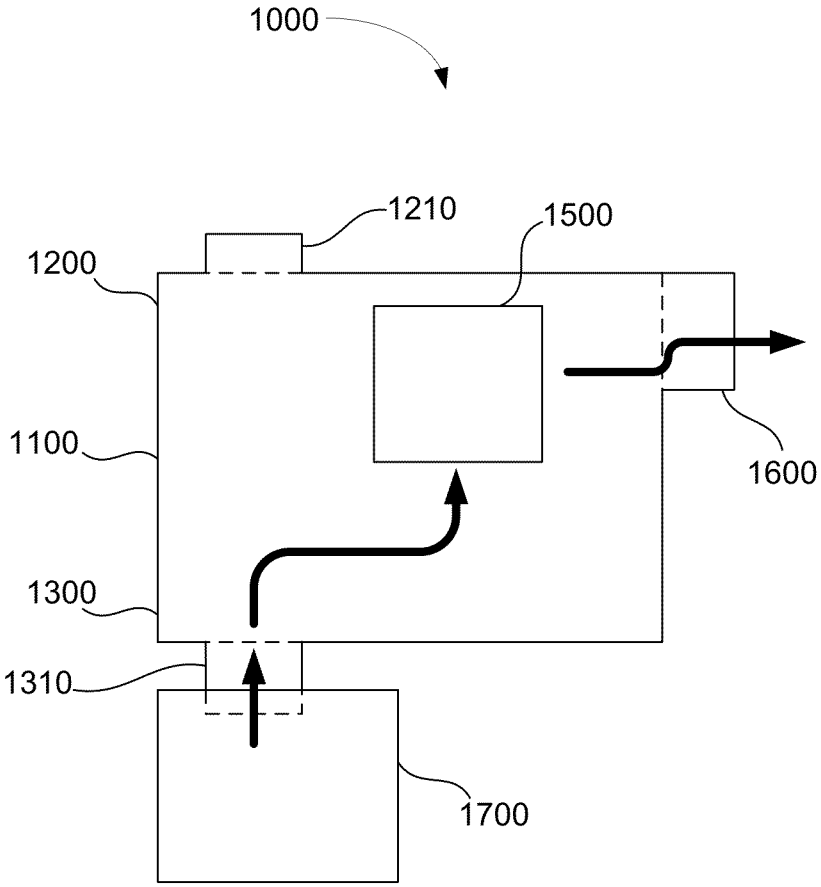
FIG. 1 is a schematic illustration of a toy water gun, according to an embodiment.

Embodiments of a toy water gun are discussed herein. In some embodiments, a toy water gun includes a housing having an upper portion, a lower portion, and an outtake port. The housing of the toy water gun (also referred to herein as "water gun") can define an internal chamber. The upper portion can include an upper intake port, and the lower portion can include a lower intake port. The toy water gun can include a pump configured to transfer fluid from the internal chamber when the lower portion is in a first configuration and transfer water from an external fluid reservoir when the lower portion is in a second configuration.

In some embodiments, a water gun includes a housing having an upper portion, a lower portion, and an outtake port. The housing of the water gun can define an internal chamber. The upper portion can include an upper intake port, and the lower portion can include a lower intake port. The upper intake port can be fluidically coupled to the internal chamber and configured to transfer a fluid to the internal chamber when the upper intake port is disposed above the lower intake port and the upper intake port receives the fluid. The water gun can include a peristaltic pump and at least one tube including a first end fluidically coupled to the lower intake port and a second end fluidically coupled to the outtake port. The peristaltic pump can be configured to selectively engage the tube and transfer fluid from the internal chamber when the lower intake port is in a first configuration and transfer water from an external fluid reservoir when the lower intake port is in a second configuration.

In some embodiments, a water gun includes a housing having an upper portion, a lower portion, and an outtake port. The housing of the water gun can define an internal chamber. The upper portion can include an upper intake port, and the lower portion can include a lower intake port. The upper intake port can be fluidically coupled to the internal chamber and configured to transfer a fluid to the internal chamber. The water gun can include a peristaltic pump and at least one tube including a first end fluidically coupled to the lower intake port and a second end fluidically coupled to the outtake port. The lower intake port can include a one-way valve and an opening. The opening defined by the lower intake port can receive a fluid from the internal chamber when the one-way valve is in a first configuration and the opening can receive a fluid from an external reservoir when the one-way valve is in a second configuration. The peristaltic pump can be configured to selectively engage the tube and transfer the fluid from the internal chamber to the outtake port when the one-way valve is in the first configuration and transfer the fluid from the external reservoir to the outtake port when the one-way valve is in the second configuration.

It is noted that, as used in this written description and the appended claims, the singular forms "a," "an" and "the" include plural referents unless the context clearly dictates otherwise. Thus, for example, the term "a boss" is intended to mean a single boss or a combination of bosses. Furthermore, in some context, the words "proximal" and "distal" refer to a direction closer to and away from, respectively, the portion of a user actively engaging the water gun. For example, an outtake port can be included in a housing at a "distal" end that is opposite a "proximal" end that includes a grip portion. In some context, the words "proximal" and "distal" refer to a direction of a fluid flow. For example, fluid can flow within a tube assembly from a lower intake port disposed at a proximal end of the water gun to an outtake port disposed at a distal end of the water gun.

As used herein, a "set" can refer to multiple features or a singular feature with multiple parts. For example, when referring to set of protrusions, the set of protrusions can be considered as one protrusion with distinct portions, or the set of protrusions can be considered as multiple protrusions. Additionally, as used herein, "fluid communication" can refer to a pathway that allows the passing of a fluid between, for example, a first component such as a housing, a reservoir, a volume and/or the like and a second component coupled to the first component. For example, a housing of a toy water gun can define an internal chamber, and an intake port of the toy water gun can be in fluid communication with the internal chamber. In such an example, the fluid entering the intake port can flow in a fluid pathway between the intake port and the internal chamber.

FIG. 1 is a schematic illustration of a toy water gun 1000, according to an embodiment. The toy water gun 1000 includes a housing 1100, having an upper portion 1200, a lower portion 1300, and an outtake port 1600, and a pump 1500. The housing 1100 can be any suitable shape, size, or configuration. For example, in some embodiments, the upper portion 1200 of the housing 1100 can form the body of the gun and be fluidically coupled to the outtake port 1600. More specifically, the upper portion 1200 can be, for example, circular, rectangular, cylindrical, and/or any other suitable shape. The outtake port 1600 can protrude from a distal end of the upper portion 1200 (i.e., away for the user). The lower portion 1300 of the water gun 1000 can form a grip portion and couple to the upper portion 1200 of the housing 1100. In some embodiments, the upper portion 1200 and the lower portion 1300 are fluidically coupled such that a pump, disposed within the upper portion 1200, can transfer a fluid from the lower portion 1300 of the gun to the outtake port 1600 and subsequently, transfer the fluid to a volume substantially outside the housing 1100. In some embodiments, the upper portion 1200 and the lower portion 1300 can be monolithically formed. In other embodiments, the upper portion 1200 and the lower portion 1300 are formed separately and are integrally coupled to form the housing 1100.

The upper portion 1200 includes an upper intake port 1210 that is fluidically coupled to at least a portion of the housing 1100. The upper intake port 1210 can be configured to protrude from a surface of the housing 1100 and can define an opening (not shown in FIG. 1) configured to receive a fluid and transfer the fluid to an internal chamber (not shown in FIG. 1). In some embodiments, the upper intake port 1210 can be monolithically formed with the housing 1100. In some embodiments, the upper intake port 1210 is defined by an opening disposed in, on, and/or through the housing (i.e., the upper intake port 1210 does not protrude from the surface of the housing 1100). Similarly, the lower portion 1300 includes a lower intake port 1310 that is fluidically coupled to at least a portion of the housing 1100. The lower intake port 1310 can protrude from a surface of the lower portion 1300 of the housing 1100 and define an opening (not shown in FIG. 1) and, as such, can be placed in fluid communication with an external fluid reservoir 1700.

The housing 1100 of the water gun 1000 includes a pump 1500. In some embodiments, the pump 1500 is a peristaltic pump configured to transfer a fluid from the lower intake port 1310 to the outtake port 1600. In some embodiments, the pump can be, for example, a squeeze bulb, a trigger pump, an air pressurized reservoir, a motorized piston, a peristaltic pump, and/or the like. The pump 1500 can be manually activated by the user (e.g., by using a crank). In some embodiments, the pump 1500 can be electronically activated in any suitable manner. For example, the water gun 1100 can include an electronic circuit configured to activate the pump 1500 when a trigger is pulled. The pump 1500 can selectively engage a tube, a hose, and/or any other suitable pathway (not shown in FIG. 1) configured to transfer a fluid from the lower intake port 1310 to the outtake port 1600. For example, as shown in FIG. 1, when the lower intake port 1310 is disposed within the external fluid reservoir 1700, the pump 1500 is configured to transfer a portion of the fluid from the lower intake port 1310 to the outtake port 1600 and thus, to a volume substantially outside the housing 1100.

Although the toy water gun 1000 is shown with one intake port located at the upper portion of the housing and another intake part located at the lower portion of housing, in other embodiments, the intake ports can be differently located. For example, in some embodiments, both intake ports can be located at the upper portion of the housing. In such embodiments, one of the intake ports can include a conduit (e.g., hose) that fluidically couples that intake port to an external reservoir located below the water gun. In other embodiments, both intake parts can be located at the lower portion of the housing. In such embodiments, one of the intake ports can be fluidically coupled to an internal reservoir and can receive external fluid while the water gun is oriented upside down. In yet other embodiments, an intake port located at the upper portion of the housing can include a conduit (e.g., hose) that fluidically couples that intake port to an external reservoir located below the water gun, and an intake port located at the lower portion of the housing can be fluidically coupled to an internal reservoir and can receive external fluid while the water gun is oriented upside down.

Figure 2:
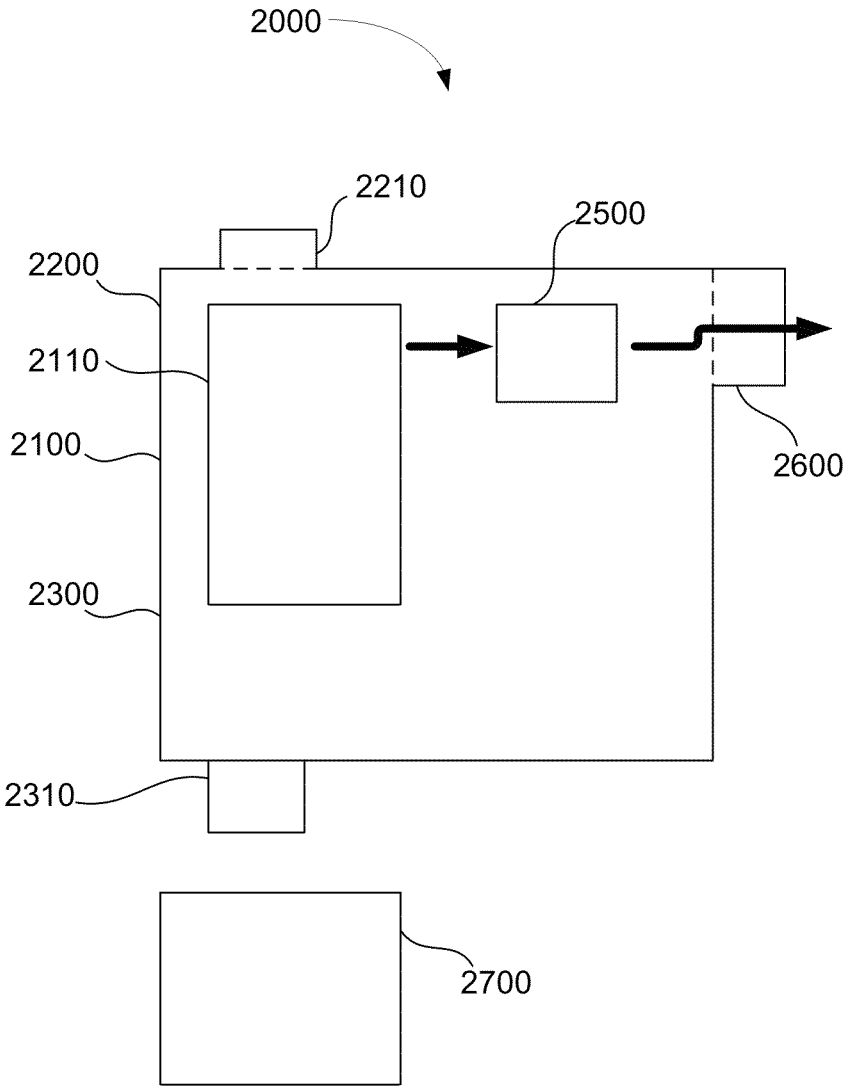
FIG. 2 is a schematic illustration of a toy water gun in a first configuration, according to an embodiment.
Figure 3:
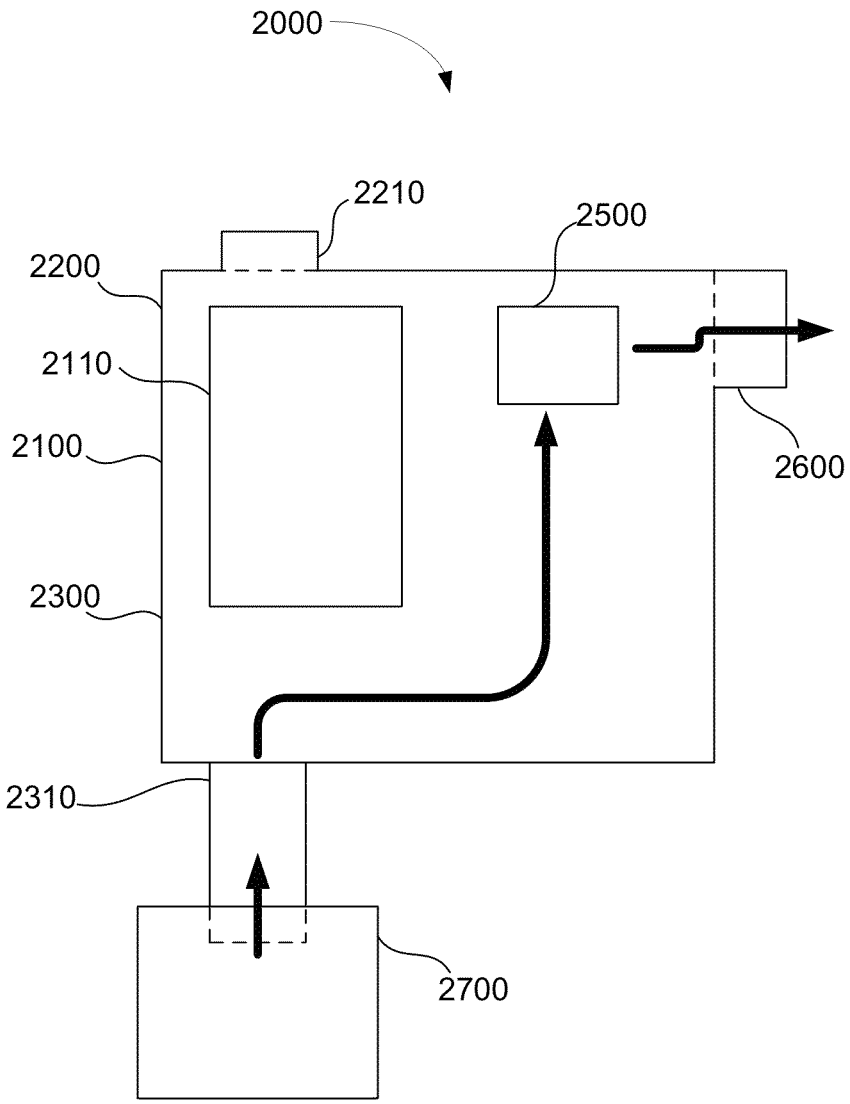
FIG. 3 is schematic illustration of the toy water gun of FIG. 2 in a second configuration.

FIGS. 2 and 3 are schematic illustrations of a toy water gun 2000 in a first configuration and second configuration, respectively, according to an embodiment. The water gun 2000 includes a housing 2100, having an upper portion 2200, a lower portion 2300, and an outtake port 2600, and a pump 2500. The housing 2100 can be any suitable shape, size, or configuration. For example, in some embodiments, the upper portion 2200 of the housing 2100 can form the body of the gun and be fluidically coupled to the outtake port 2600. More specifically, the upper portion 2200 can be, for example, circular, rectangular, cylindrical, and/or any other suitable shape. The outtake port 2600 can protrude from a distal end of the upper portion 2200 (i.e., away for the user). The lower portion 2300 of the water gun 2000 can form a grip portion and couple to the upper portion 2200 of the housing 2100. In some embodiments, at least a portion of the lower portion 2200 and the upper portion 2300 are fluidically coupled such that a fluid can be transferred from the lower portion 2300 of the gun to the outtake port 2600 and subsequently, transferred to a volume substantially outside the housing 2100.

The housing 2100 defines an internal chamber 2110. The internal chamber 2110 can be configured to house a fluid and can be fluidically coupled to at least a portion of the lower portion 2300. More specifically, the internal chamber 2110 fluidically couples to a lower intake port 2310 included in the lower portion 2300 of the housing 2100. The upper portion 2200 includes an upper intake port 2210 that is fluidically coupled to the internal chamber 2110 defined by the housing 2100. The upper intake port 2210 can be configured to protrude from a surface of the housing 2100 and can define an opening (not shown in FIG. 1) configured to receive a fluid and transfer the fluid to the internal chamber 2110. In some embodiments, the upper intake port 2210 can be monolithically formed with the housing 2100. In some embodiments, the upper intake port 2210 can be defined by an opening disposed in, on, and/or through the housing (i.e., the upper intake port 2210 does not protrude from the surface of the housing 2100). Similarly, the lower portion 2300 includes a lower intake port 2310 that is fluidically coupled to at least a portion of the housing 2100 and is in fluid communication with at least a portion of the internal chamber 2110. The lower intake port 2310 can protrude from a surface of the lower portion 2300 of the housing 2100 and define an opening (not shown in FIGS. 2 and 3) and, as such, can be placed in fluid communication with an external fluid reservoir 2700.

A pump 2500 can be disposed within the housing 2100 of the water gun 2000. In some embodiments, the pump can be, for example, those described above. The pump 2500 can be manually activated by the user (e.g., by using a crank). In some embodiments, the pump 2500 can be electronically activated. The pump 2500 can selectively engage a tube, a hose, and/or any other suitable fluid pathway (not shown in FIGS. 2 and 3) configured to transfer a fluid from the lower intake port 2310 to the outtake port 2600. For example, as shown in FIG. 2, when the lower intake port 2310 is in a first configuration (e.g., the lower intake port 2310 is not in fluid communication with the external fluid reservoir 2700), the pump 2500 can transfer a portion of a fluid from the internal chamber 2110 to the outtake port 2600. When the lower intake port 2310 is in a second configuration (e.g., the lower intake port 2310 is disposed within and in fluid communication with the external fluid reservoir 2700, as shown in FIG. 3), the pump 2500 is configured to transfer a portion of a fluid from the external fluid reservoir 2700 through the lower intake port 2310 to the outtake port 2600. Thus, when the lower intake port 2310 is in the second configuration, the internal chamber 2110 is not in fluid communication with the pump 2500, as described in further detail herein.

Figure 4:
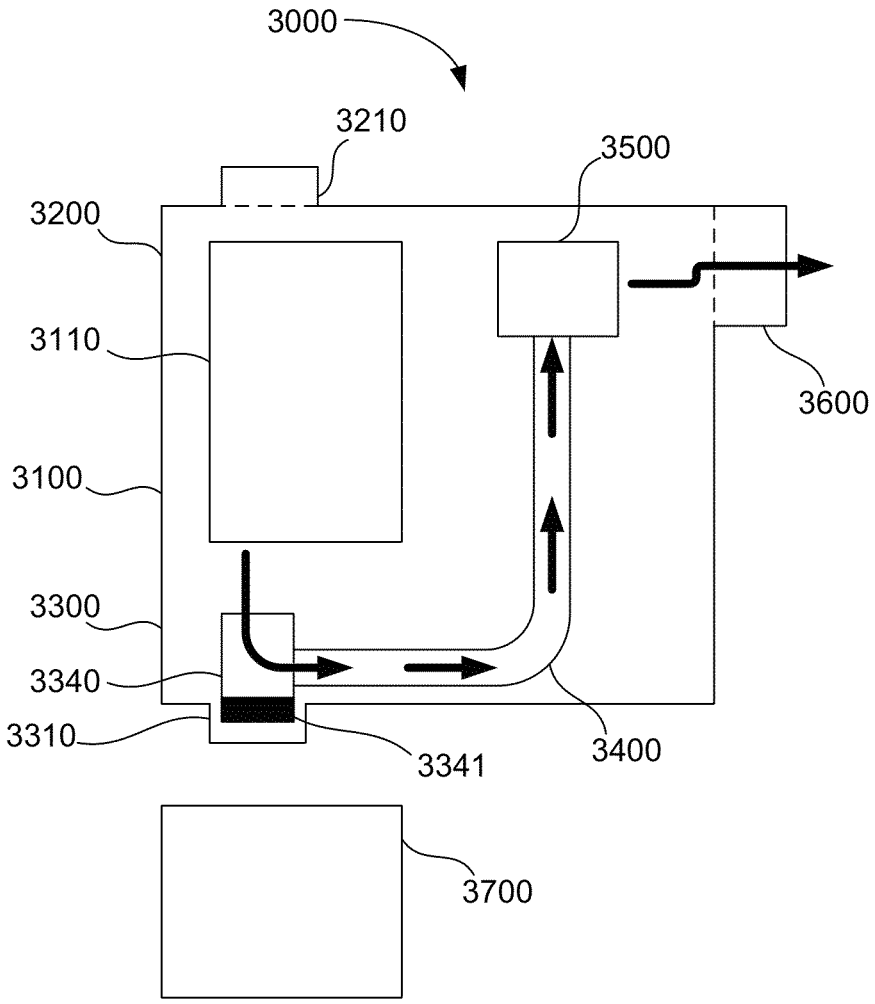
FIG. 4 is a schematic illustration of a toy water gun in a first configuration, according to an embodiment.
Figure 5:
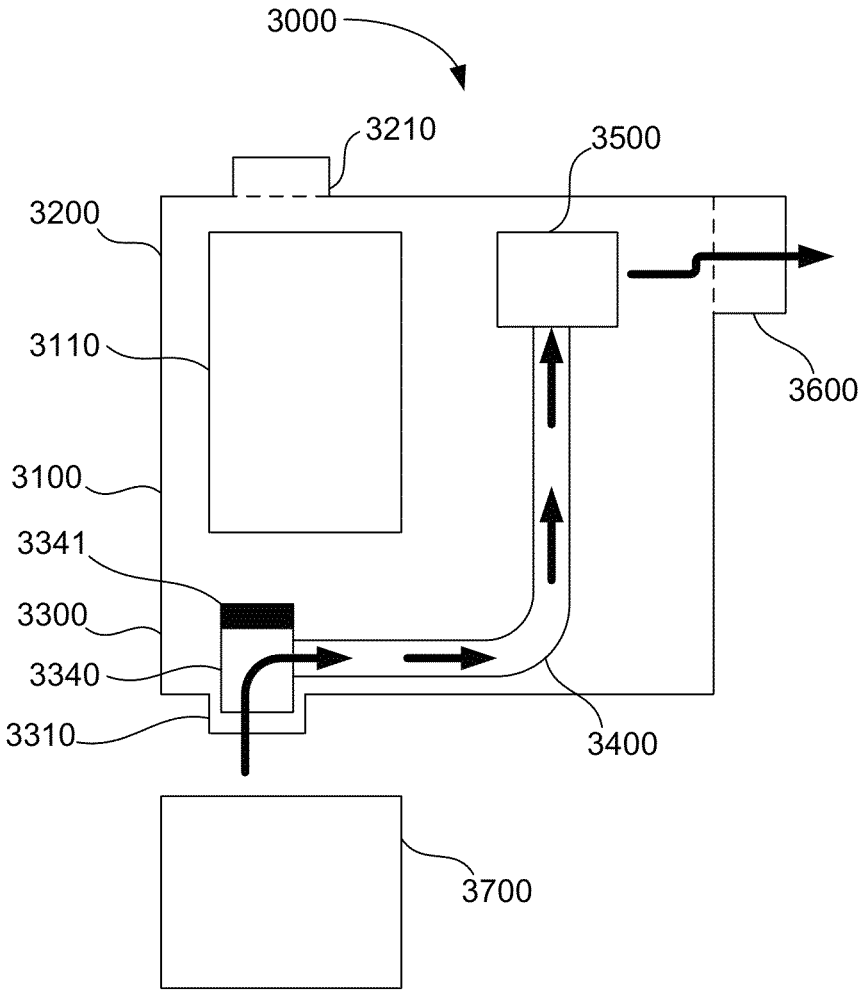
FIG. 5 is a schematic illustration of the toy water gun of FIG. 4 is a second configuration.

FIGS. 4 and 5 are schematic illustrations of a toy water gun 3000 in a first configuration and second configuration, respectively, according to an embodiment. The water gun 3000 includes a housing 3100, having an upper portion 3200, a lower portion 3300, and an outtake port 3600, and a pump 3500. The housing 3100 can be any suitable shape, size, or configuration, for example, as described above. The outtake port 3600 can protrude from a distal end of the upper portion 3200 (i.e., away for the user). In some embodiments, at least a portion of the lower portion 3200 and the upper portion 3300 are fluidically coupled such that a fluid can be transferred from the lower portion 3300 of the gun to the outtake port 3600 and subsequently, transferred to a volume substantially outside the housing 3100.

The housing 3100 defines an internal chamber 3110. The internal chamber 3110 can be configured to house a fluid and can be fluidically coupled to at least a portion of the lower portion 3300. In some embodiments, the internal chamber 3110 fluidically couples to a lower intake port 3310 included in the lower portion 3300 of the housing 3100. The upper portion 3200 includes an upper intake port 3210 that is fluidically coupled to the internal chamber 3110 defined by the housing 3100. The upper intake port 3210 can be substantially similar to the upper intake port 2210 described in reference to FIG. 2. In some embodiments, the internal chamber 3110 can be included in the housing 3100. For example, the internal chamber 3110 can include a set of walls and/or a boundary that defines a volume containing a fluid and, as such, can be disposed within the housing 3100.

The lower portion 3300 includes a lower intake port 3310 that is fluidically coupled to at least a portion of the housing 3100. The lower intake port 3310 can protrude from a surface of the lower portion 3300 of the housing 3100 and define an opening (not shown in FIGS. 4 and 5) and, as such, can be placed in fluid communication with an external fluid reservoir 3700. The lower intake port 3310 includes a valve assembly 3340 having a one way valve 3341. The valve assembly 3340 can move between a first configuration (FIG. 4) and a second configuration (FIG. 5), as further described herein.

The housing 3100 of the water gun 3000 includes a pump 3500. In some embodiments, the pump can be, for example, those described above. The pump 3500 can be manually activated by the user (e.g., by using a crank). In some embodiments, the pump 3500 can be electronically activated. The pump 3500 selectively engages a tube 3400 configured to transfer a fluid from the lower portion 3300 to the outtake port 3600. More specifically, a first end of the tube 3400 fluidically couples to the lower intake port 3310 and a second end of the tube 3400 fluidically couples to the outtake port 3600. With the valve assembly 3340 in the first configuration, the pump 3500 is configured to selectively engage the tube 3400 and transfer a portion of the fluid contained in the internal chamber 3110 through the lower intake port 3310 and to the outtake port 3600. Similarly stated, when the valve assembly 3340 is in the first configuration, the valve 3341 is configured to allow a fluid flow from the internal chamber 3110 through the valve assembly 3340 and block a fluid flow into or out of the opening (not shown) defined by the lower intake port 3310, as shown in FIG. 4.

With the valve assembly 3340 in the second configuration (FIG. 5), the pump 3500 is configured to selectively engage the tube 3400 and transfer a portion of the fluid contained in the external fluid reservoir 3700 through the lower intake port 3310 and to the outtake port 3600. Similarly stated, when the valve assembly 3340 is in the second configuration, the valve 3341 is configured to allow the fluid flow from the external fluid reservoir 3700 through the lower intake port 3310 and block the fluid flow into or out of the internal chamber 3110.

Figure 6:
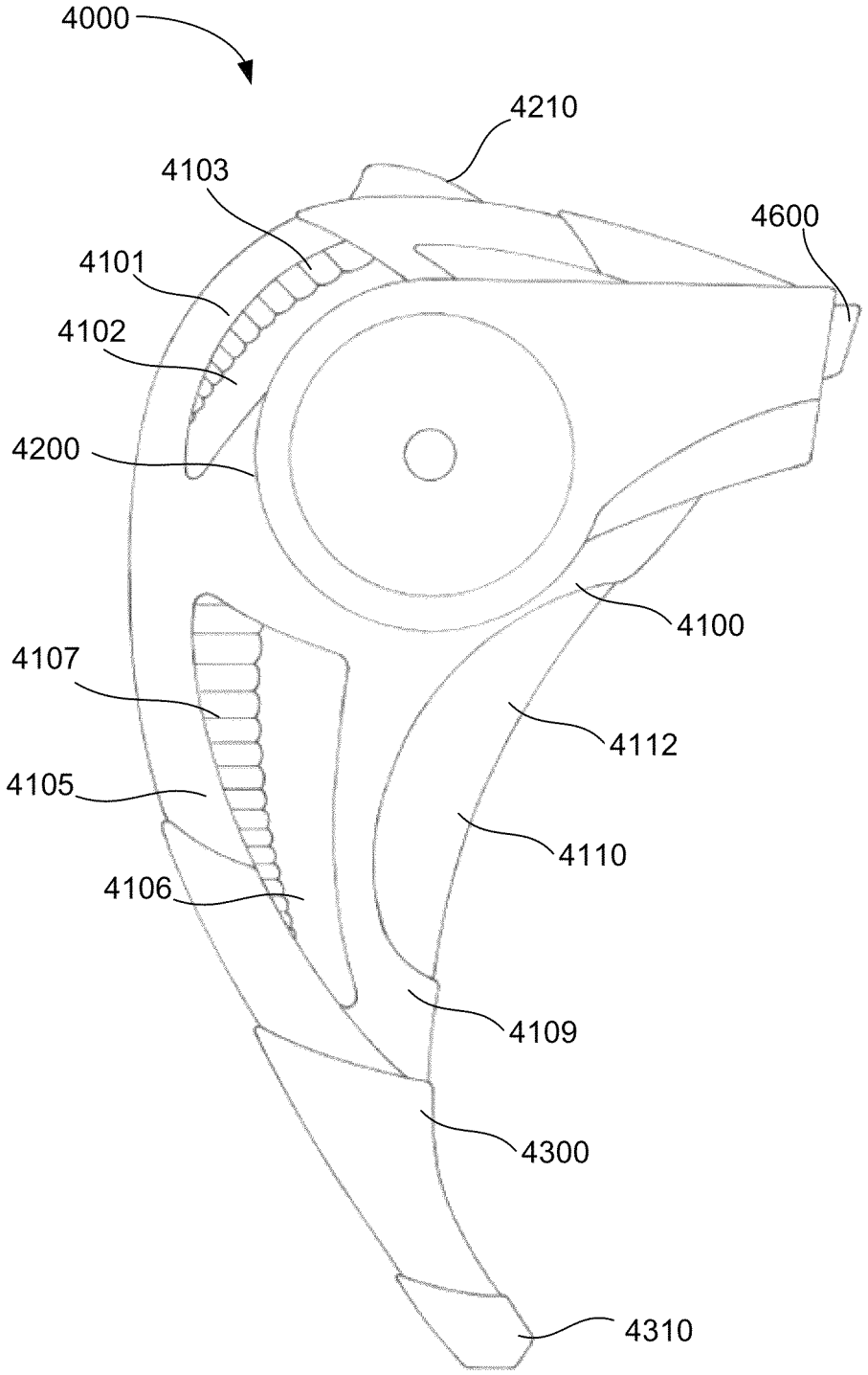
FIG. 6 is a side view of a portion of a toy water gun, according to an embodiment.

Referring now to FIGS. 6-27, a toy water gun 4000 can include a housing 4100, having an upper portion 4200 a lower portion 4300 and an outtake port 4600, and pump assembly 4500. As shown in FIG. 6, the housing 4100 can have a given shape with substantially curved features. In some embodiments, the housing 4100 can define any suitable shape, size, or configuration. The housing 4100 can include a first handle 4101 and a second handle 4105. The first handle 4101 and the second handle 4105 can extend from a portion of the housing 4100 and can be any suitable size or shape. The first handle 4101 can define an opening 4102 configured to accept at least a portion of a user's hand allowing the user to grip the first handle 4101. Additionally, the first handle 4101 can include a grip portion 4103 having a set of ridges and/or texture to provide an ergonomic fit with the user's hand. In some embodiments, the grip portion 4103 can include a sandblasted finish configured to increase the friction between the grip portion 4103 and the user's hand. Similarly, the second handle 4105 includes an opening 4106 and a grip portion 4107. The second handle 4105 can be substantially similar in function and configuration as the first handle 4101. While shown in FIG. 6 as extending from the rear of the housing 4100, the first handle 4101 and the second handle 4105 can be disposed on the housing 4100 at any location such as to increase the ergonomics of the water gun 4000.

The housing 4100 can include an internal chamber 4110 configured to house, store, contain, or otherwise include a fluid within a volume 4113 defined by a set of walls 4112 of the internal chamber 4110. In some embodiments, an outer surface of the walls 4112 of the internal chamber 4110 can include a similar sandblasted texture as described above. The upper portion 4200 of the housing 4100 includes an upper intake port 4210 fluidically coupled to the internal chamber 4110 and configured to receive a fluid therethrough. The upper intake port 4210 can be monolithically formed with the upper portion 4200 of the housing 4100. Similarly stated, the upper portion 4200 can include an extension that can define the upper intake port 4210. The outtake port 4600 can also be disposed within the upper portion 4200 of the housing 4100. In some embodiments, the outtake port 4600 is monolithically formed with the upper portion 4200 of the housing 4100. In other embodiments, the outtake port 4600 is fluidically coupled to the upper portion 4200 of the housing 4100 (e.g., formed from a separate piece of material and assembled such as to be in fluid communication with the upper portion 4200 of the housing 4100). Similar to the upper portion 4200, the lower portion 4300 of the housing 4100 can include a lower intake port 4310 and is described in further detail herein.

Figure 7:
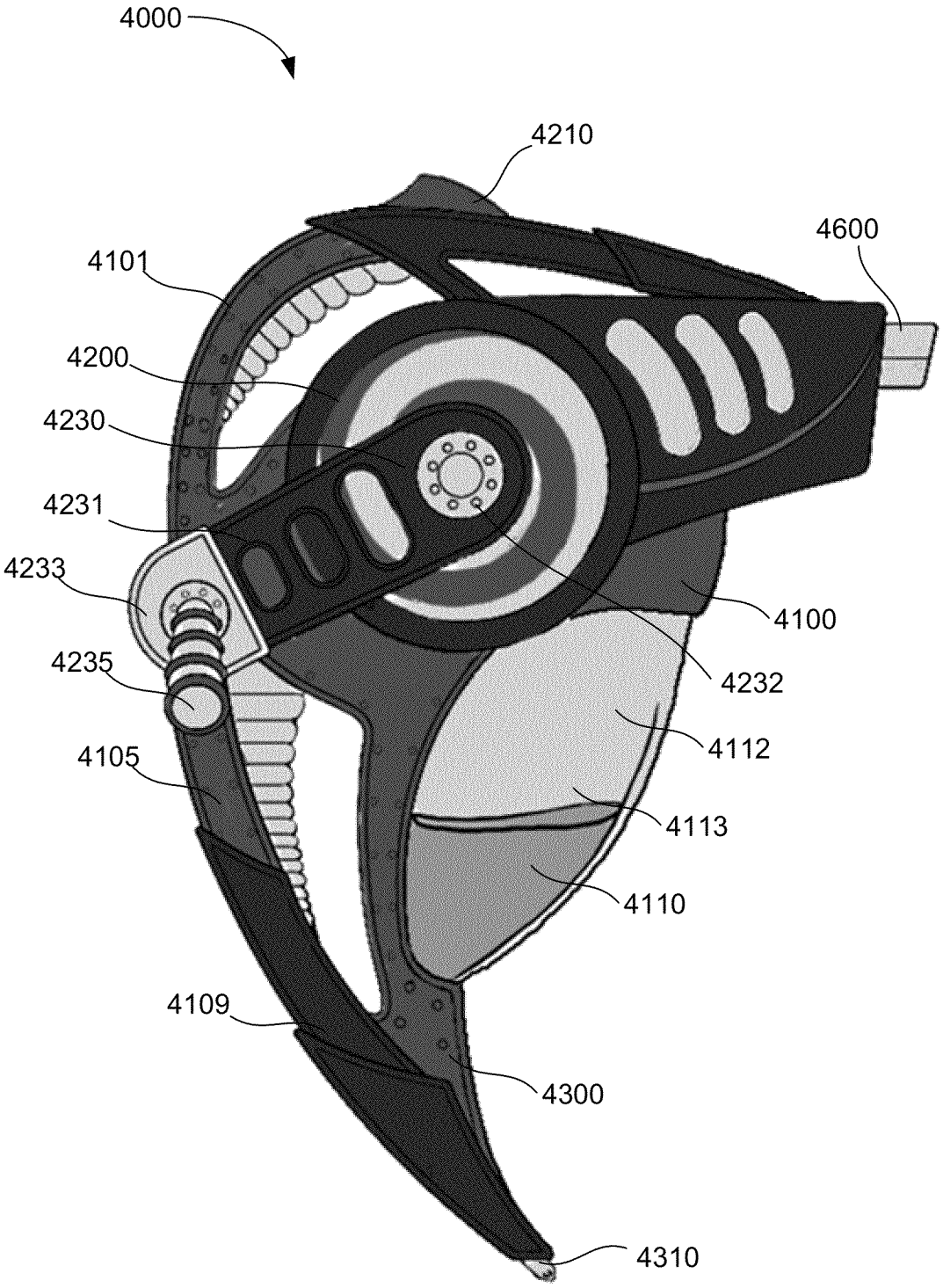
FIG. 7 is a side view of the toy water gun of FIG. 6.

The upper portion 4200 of the housing 4100 can also include a crank 4230, as shown in FIG. 7. The crank 4230 can include a crank arm 4231 and a handle 4235. The crank 4230 is rotatably coupled to the housing 4100. More specifically, the crank arm 4231 includes a first end 4232 that is rotatably coupled to the housing 4100. The crank arm 4231 can define any suitable shape, size or configuration as well as include any suitable surface treatment. For example, the crank arm 4231 can be a thin, substantially oblong extension. The handle 4235 is coupled to a second end 4233 of the crank arm 4231 and can define any suitable shape and/or size. Additionally, the handle 4235 can include any suitable surface treatment such as, for example, a sandblasted finish, ribs, dimples, and/or the like.

Figure 8:
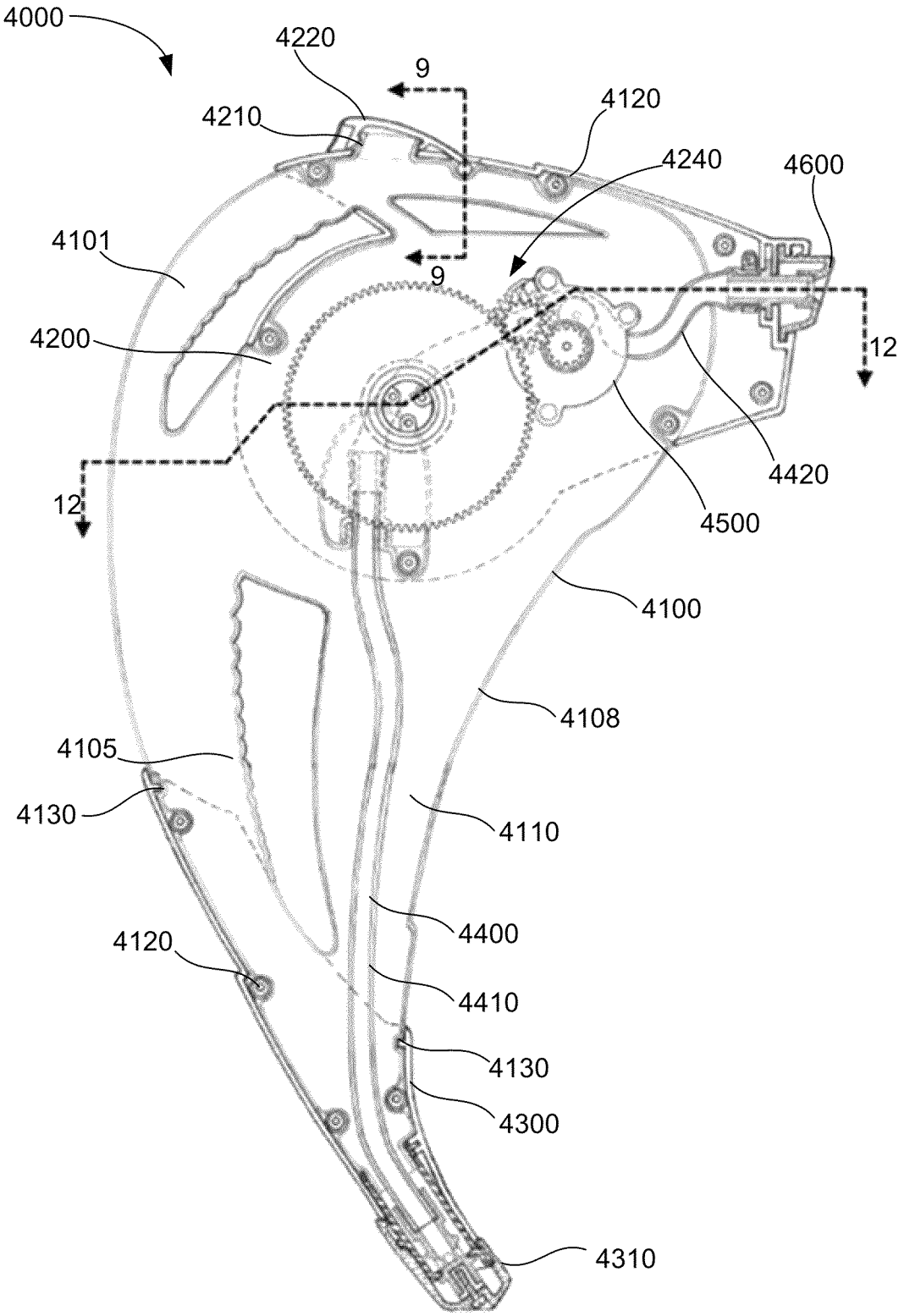
FIG. 8 is a cross-sectional view of the toy water gun of FIG. 6.
Figure 9:
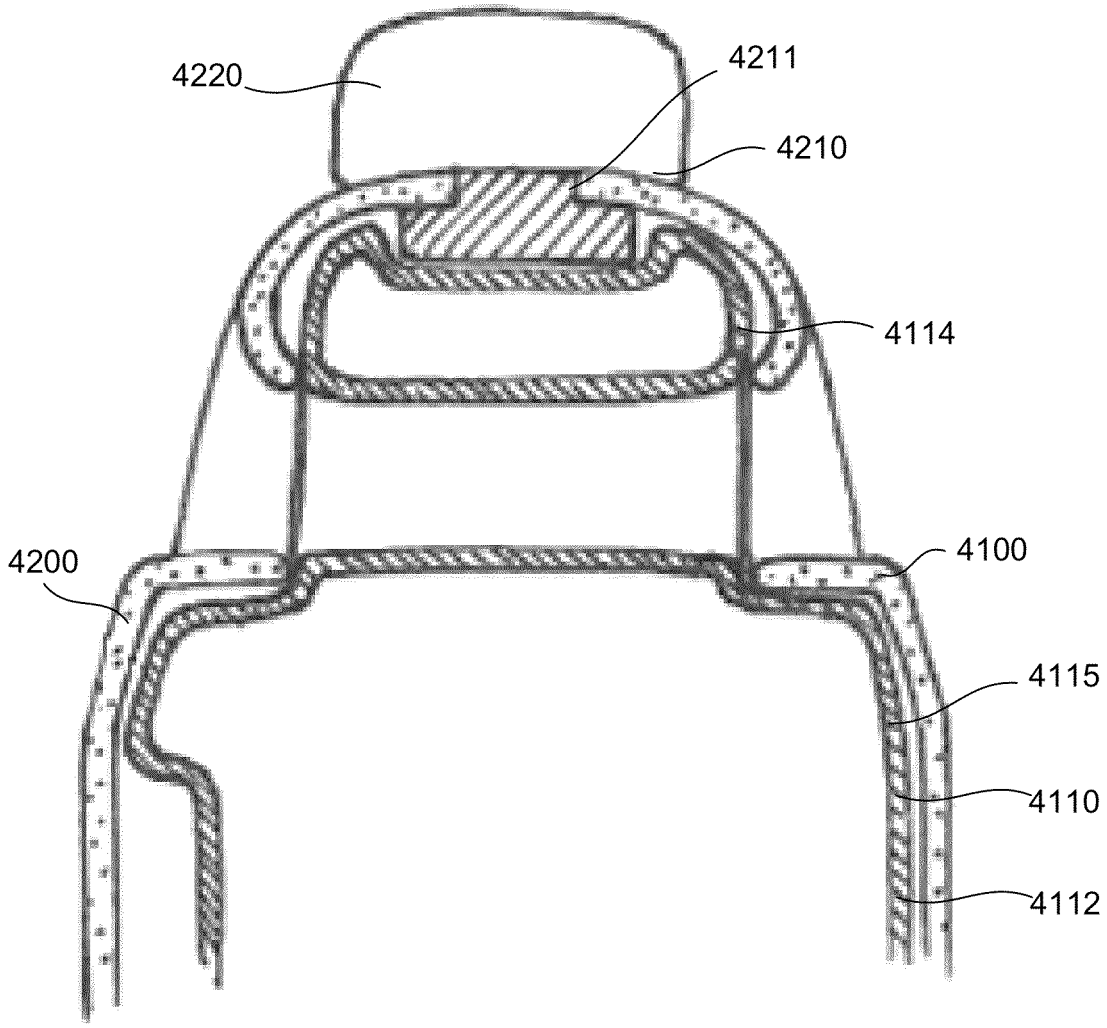
FIG. 9 is a cross-sectional view of the toy water gun taken along the line 9-9 in FIG. 8.
Figure 11:
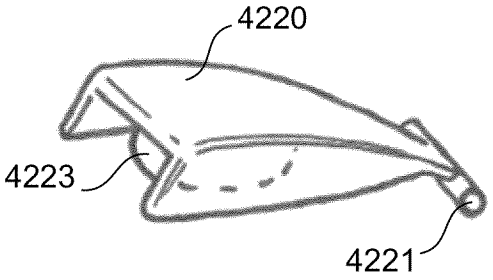
FIG. 11 is a perspective view of a flip cap include in the toy water gun of FIG. 6.
Figure 10:
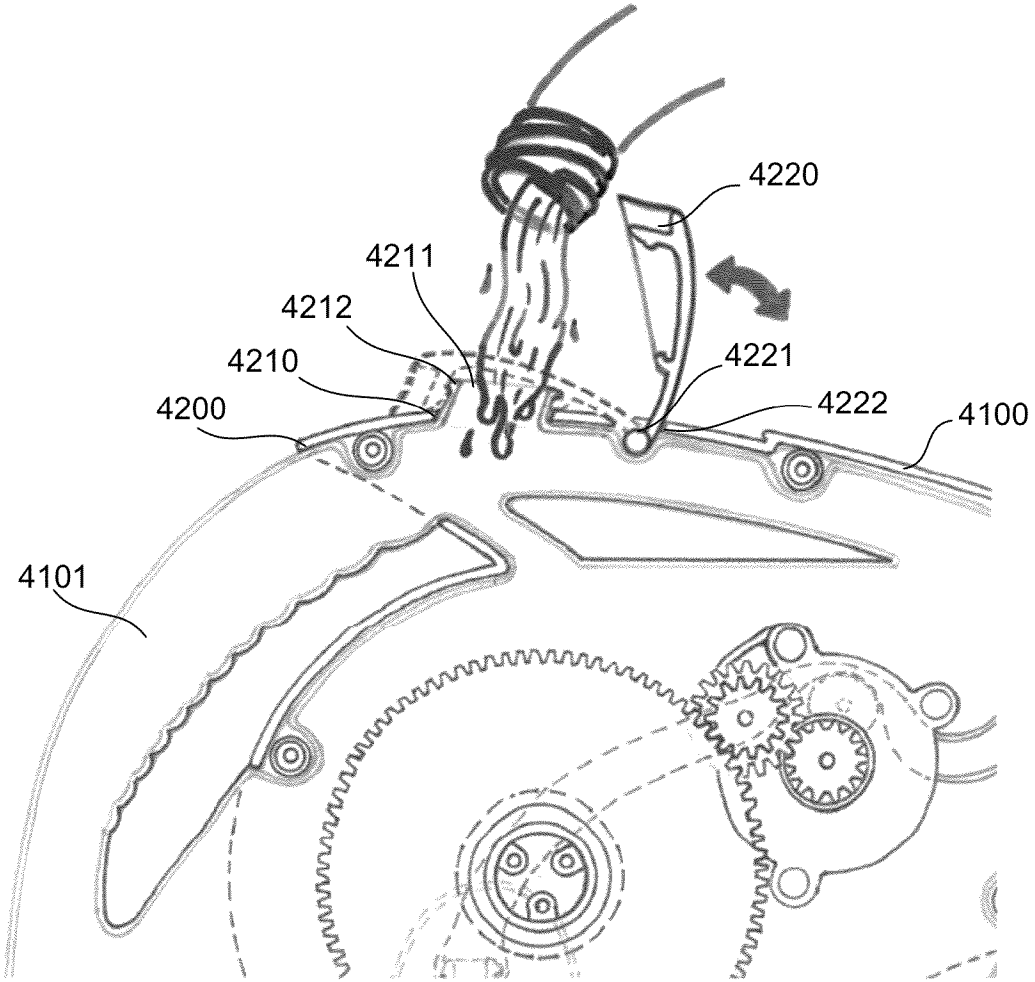
FIG. 10 is a cross-sectional view of an upper portion of the toy water gun of FIG. 6.

The housing 4100 includes a first side 4108 (FIG. 8) and a second side 4109 (FIG. 6) configured to couple to the first side 4108. The first side 4108 and the second side 4109 include a set of bosses 4120 (FIG. 8) configured to accept a set of mounting screws, thereby coupling the second side 4109 to the first side 4108. Additionally, the first side 4108 and the second side 4109 of the housing 4100 include mounting slots 4130 configured to align the first side 4108 and the second side 4109 of the housing 4100 during assembly. The housing 4100 is configured to encase at least the internal chamber 4110, a gear system 4240, a tube assembly 4400, and a pump assembly 4500, as shown in FIG. 8. The internal chamber 4110 includes an upper portion 4114 and a main portion 4115 (FIG. 9). The upper portion 4114 is fluidically coupled to the upper intake port 4210 and is configured to transfer a fluid from the upper intake port 4210 to the main portion 4115 of the internal chamber 4110. More specifically, the upper intake port 4210 defines an opening 4211 such that a fluid pathway between the upper intake port 4210 and the upper portion 4114 of the internal chamber 4110 exists. The upper portion 4200 of the housing 4100 includes a flip cap 4220 configured to engage the upper intake port 4210, as shown in FIGS. 10 and 11. The flip cap 4220 includes a seal member 4223 that couples to the upper intake port 4210, defining a snap fit. In some embodiments, the seal member 4223 can include an o-ring, or membrane that can fluidically seal the upper intake port 4210. In some embodiments, the seal member 4223 is a plug configured to be inserted into the opening 4211 defined by the upper intake port 4210, defining a fluidic seal. The flip cap 4220 includes a hinge 4221 about which the flip cap 4220 can pivot between a first (sealed) configuration and a second (open) configuration (FIG. 10). The upper portion 4200 of the housing 4100 includes a stop 4222 that can engage the flip cap 4220 and prevent the flip cap 4220 from pivoting beyond the second configuration. In other words, the stop 4220 defines one end of the range of motion of the flip cap 4220.

Figure 12:
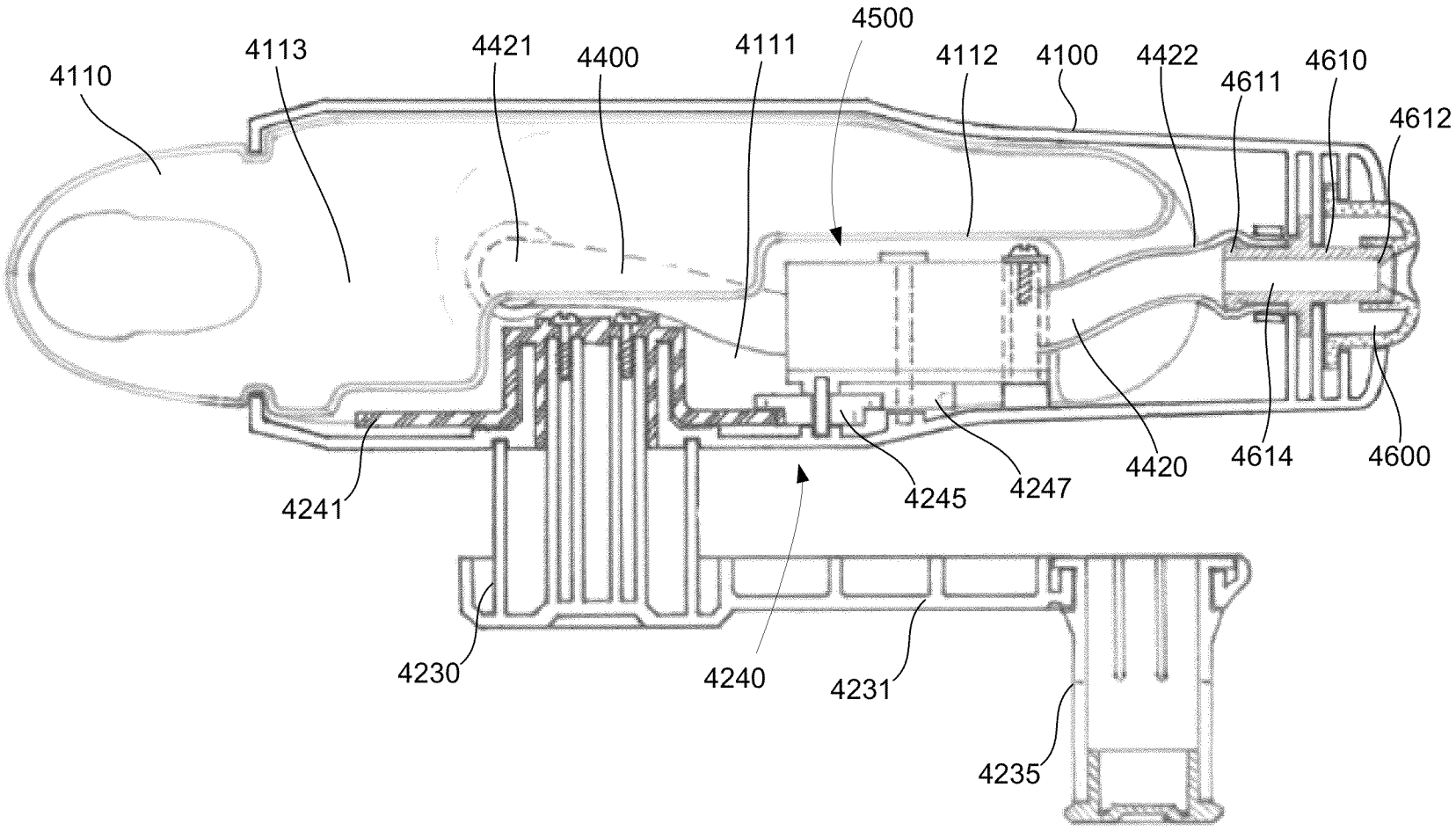
FIG. 12 is a cross-sectional view of the toy water gun taken along the line 12-12 in FIG. 8.

The internal chamber 4110 includes a recessed portion 4111 configured to provide room for the gear system 4240, the tube assembly 4400, and the pump assembly 4500, as shown in FIG. 12. The tube assembly 4400 can include a PVC portion 4410 (FIG. 8) and a flexible tube portion 4420. The gear system 4240 is configured to transfer a rotational motion, produced by the user turning the crank, to at least a portion of the pump assembly 4500. The pump assembly 4500 is configured to selectively engage at least a portion of the flexible tube portion 4420 in a peristaltic motion and produce a pressure difference such that a fluid is transferred from one end of the tube assembly to a second end of the tube assembly. In some embodiments, each portion of the tube assembly can be a flexible tube. In such embodiments, the flexible tubes can be substantially similar in durometer and/or flexibility. In other embodiments, one portion of the tube assembly can be formed of a higher durometer and/or be less flexible than the other portion of the tube assembly, such as to not collapse under a negative pressure produced by the pump.

Figure 13:
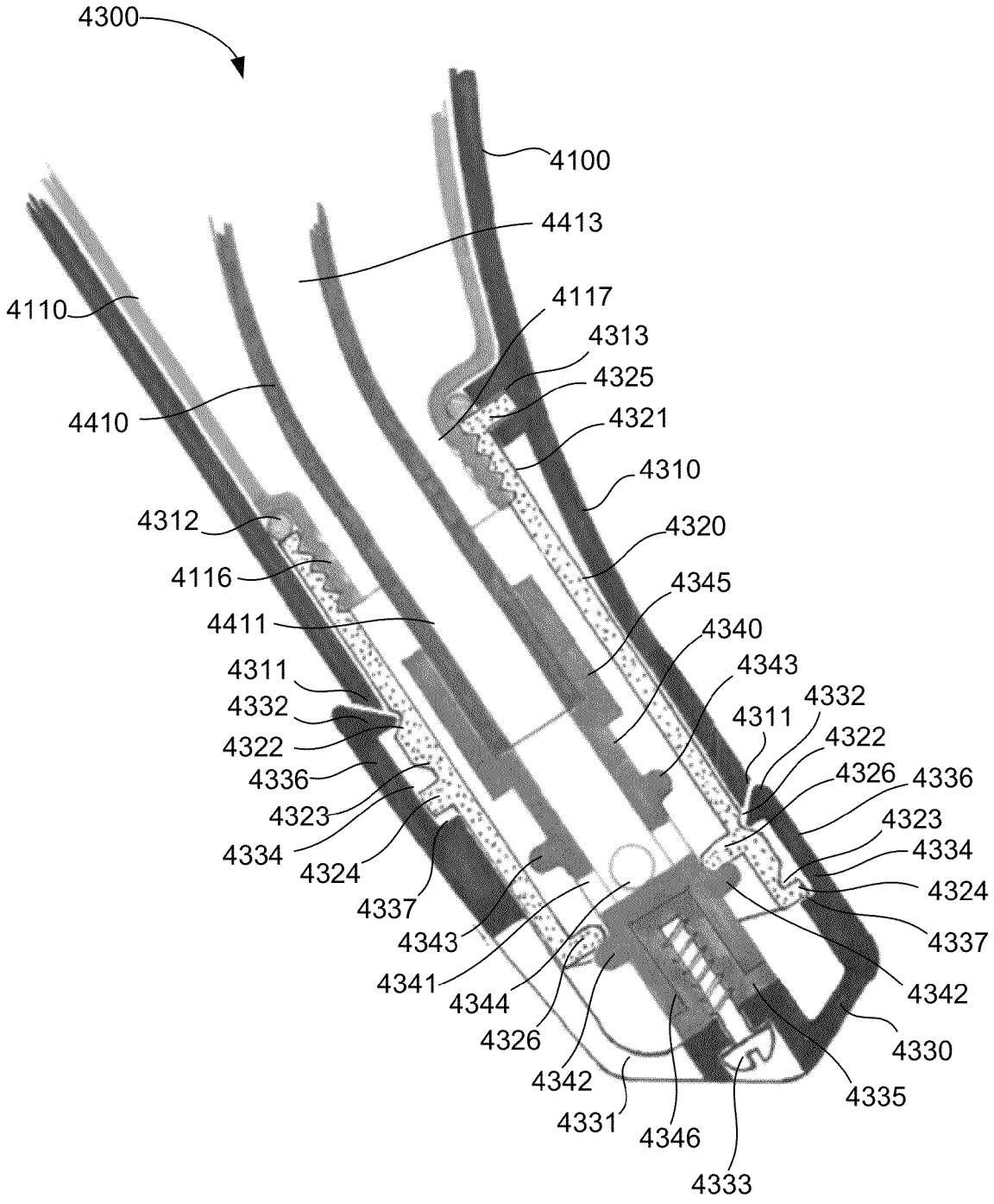
FIG. 13 is an enlarged cross-sectional view of the lower portion of the toy water gun of FIG. 6 in a first configuration.
Figure 14:
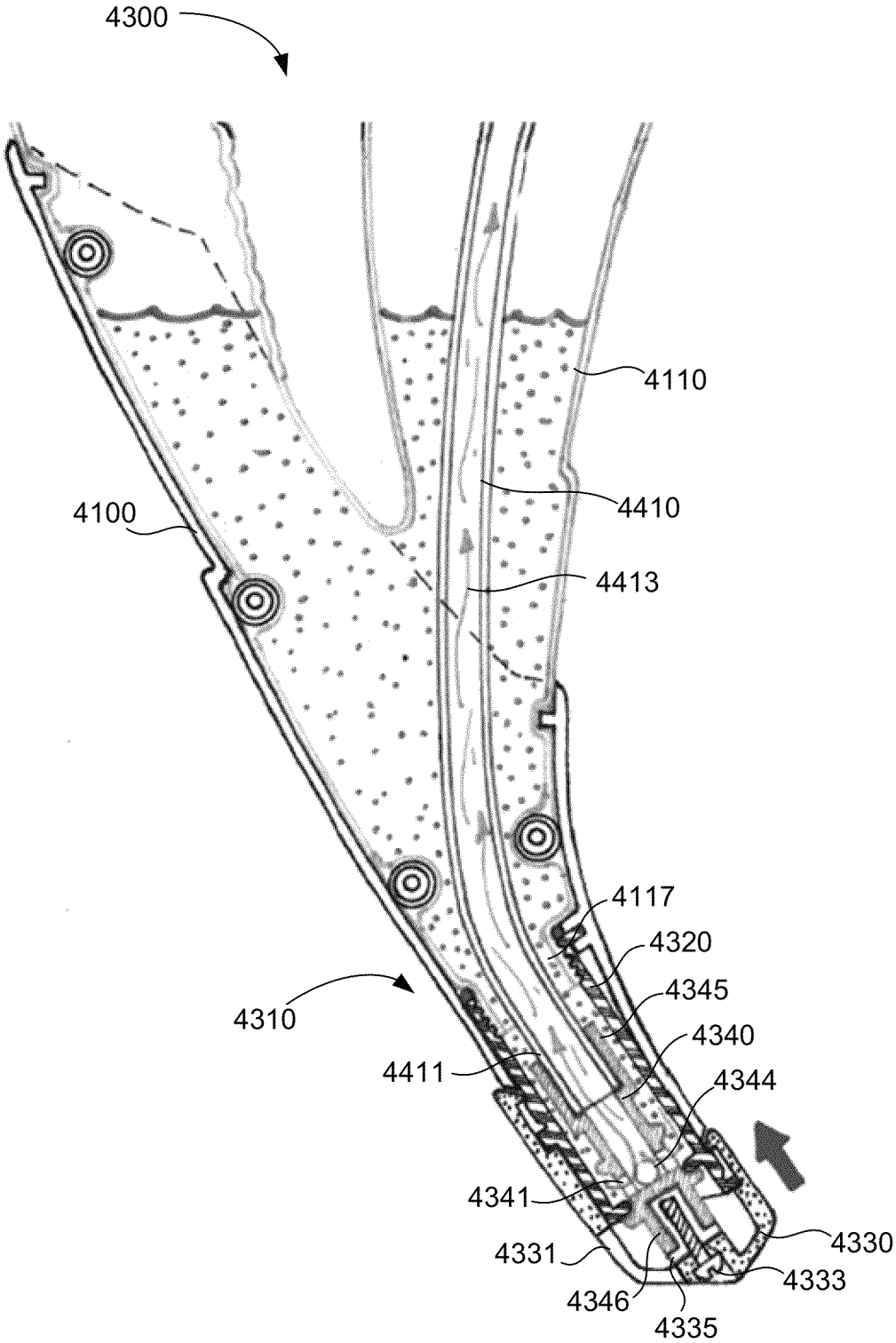
FIG. 14 is a cross-sectional view of a lower portion of the toy water gun of FIG. 6 in use in the first configuration.
Figure 15:
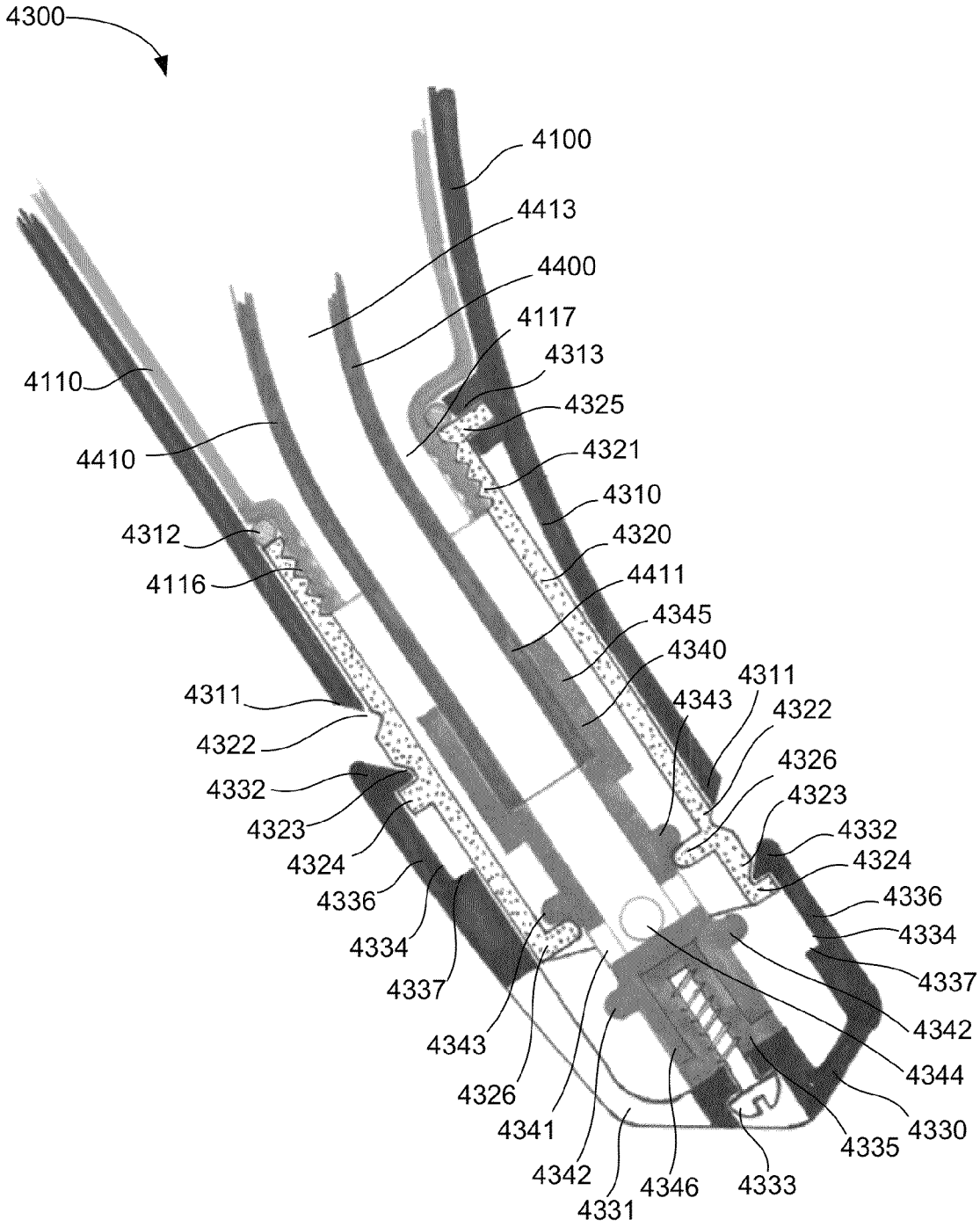
FIG. 15 is an enlarged cross-sectional view of the lower portion of the toy water gun of FIG. 6 in a second configuration.
Figure 16:
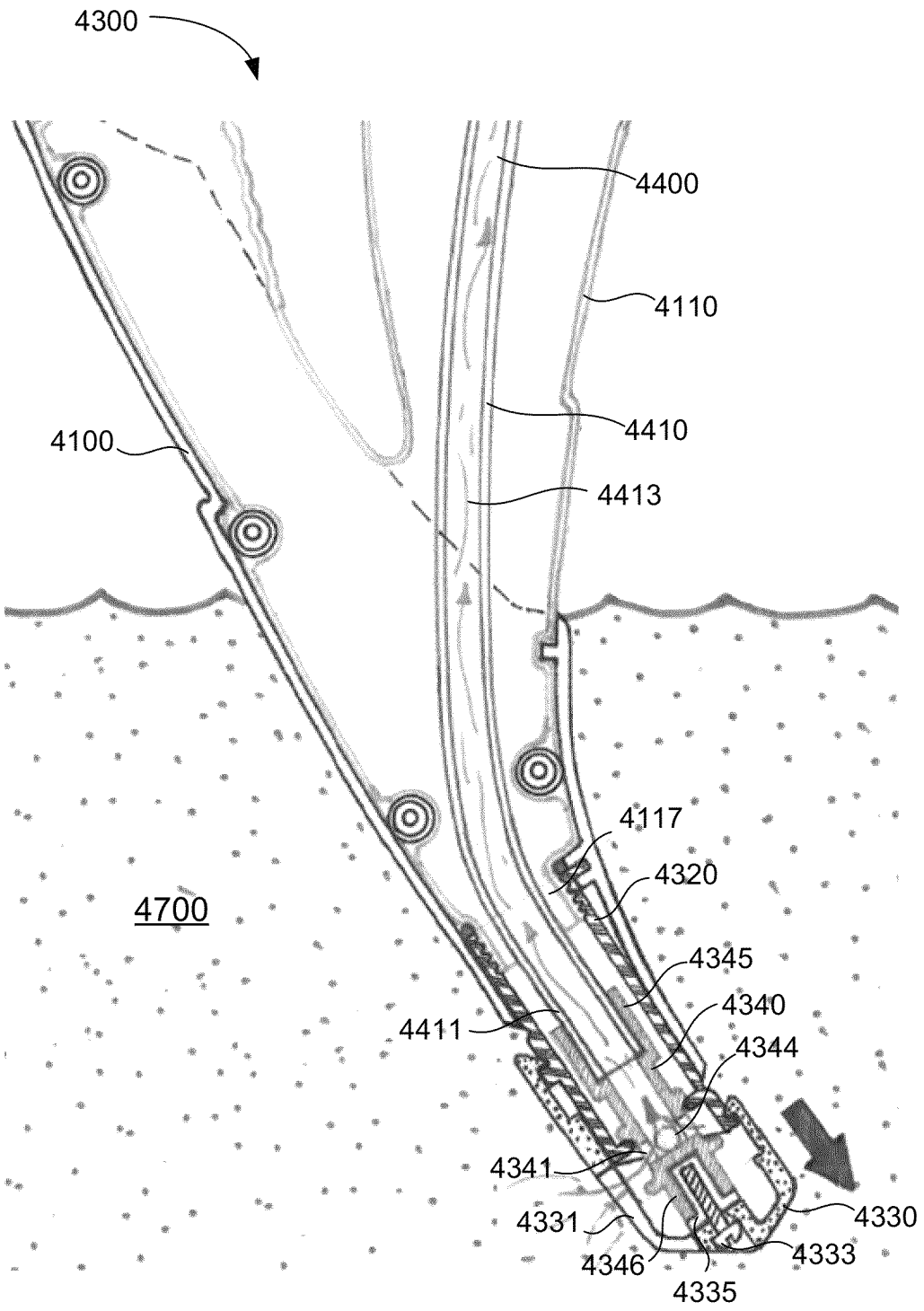
FIG. 16 is a cross-sectional view of the lower portion of the toy water gun of FIG. 6 in use in the second configuration.

FIGS. 13 and 14 illustrate the lower portion 4300 of the water gun 4000 in a first configuration. As described above, the lower portion 4300 includes the lower intake port 4310. The lower intake port 4310 is configured to engage a valve guide 4320, a valve cap 4330, and a valve assembly 4340. The internal chamber 4110 includes a lower threaded portion 4116 and defines an opening 4117. The valve guide 4320 includes a threaded portion 4321 configured to couple to the lower threaded portion 4116 of the internal chamber 4110. A sealing member 4312 can be disposed above the lower threaded portion 4116 of the internal chamber 4110 and define a substantially fluid-tight seal, such that a fluid, disposed within the internal chamber 4110, substantially does not flow between the lower threaded portion 4116 of the internal chamber 4110 and the threaded portion 4321 of the valve guide 4320. Additionally, the lower portion 4300 includes a slot 4313 that receives a flange 4325 included in the valve guide 4320. In this manner, the slot 4313 and the flange 4325 reduce movement and/or rotation of the valve guide 4320 as well as provide an alignment during assembly. The valve cap 4330 and the valve assembly 4340 adjustably couple to the valve guide 4320 and move between the first configuration (FIGS. 13 and 14) and a second configuration (FIGS. 15 and 16).

The valve guide 4320 includes a set of upper notches 4322 and a set of lower notches 4323, a set of valve cap stops 4324 and a set of sealing protrusions 4326. The valve cap 4330 includes a set of snap arms 4336 and a fluid slot 4331. In some embodiments, the fluid slot 4331 can be any shape or size. In some embodiments, the fluid slot 4331 forms an opening and/or aperture. The snap arms 4336 adjustably engage the valve guide 4320. More specifically, the snap arms 4336 include a snap tab 4332. While in the first configuration, the snap tabs 4332 engage the upper notches 4322. The upper notches 4322 can removably lock and/or maintain the valve cap 4330 in the first configuration such that an external force (e.g., the user pulling downward on the valve cap 4330) is used to move the valve cap from the first configuration. The lower intake port 4310 includes a set of tapered stops 4311 configured to engage the snap tabs 4332 when the valve cap 4330 is in the first configuration, and prevent the valve cap 4330 from moving beyond the position defined in the first configuration. The snap arms 4336 define a recessed portion 4334 having a lower surface 4337 that abuts, engages, or otherwise contacts the valve cap stops 4324 when in the first configuration. In this manner, the valve cap stops 4324 and the lower surface 4337 of the recessed portion 4334 prevent the valve cap 4330 from moving in an upward direction beyond the first configuration. This can, for example, prevent damage of the valve assembly 4340 and/or valve cap 4330.

The valve assembly 4340 includes a valve-plug-receiving portion 4346 configured to couple the valve assembly 4340 to the valve cap 4330. More specifically, the valve cap 4330 includes a valve plug 4335. The valve plug 4335 can be inserted into the valve-plug-receiving portion 4346 of the valve assembly 4340. The valve plug 4335 can be formed from any suitable material, such as, for example, rubber. A plug screw 4333 is configured to be inserted through the valve cap 4330 and into the valve plug 4335. As the plug screw 4333 is inserted into the valve plug 4335, the outer diameter and/or size of the valve plug 4335 increases and defines a friction fit within the valve-plug-receiving portion 4346, thereby coupling the valve assembly 4340 to the valve cap 4330.

The valve assembly 4340 includes a tube-receiving portion 4345 at the distal end and is configured to receive the proximal end 4411 of the PVC portion 4410 of the tube assembly 4400. The PVC tube can couple to the tube-receiving portion 4345 of the valve assembly 4340 in any suitable fashion. For example, in some embodiments, the PVC tube 4410 can be glued to the tube receiving portion 4345 of the valve assembly using PVC glue. The valve assembly 4340 also includes a valve 4341, an upper valve seal 4343, a lower valve seal 4342, and a set of openings 4344. When in the first configuration, the lower valve seal 4342 defines a substantially fluid-tight contact and/or seal with the bottom surface of the sealing protrusions 4326, thereby substantially sealing the lower intake port 4310 from an external fluid source. As shown in FIG. 14, the set of openings 4344 of the valve 4341 receive a portion of a fluid stored within the internal chamber 4110. In this manner, the pump assembly 4500 can be configured to define a negative pressure such that the fluid can be transported from the internal chamber 4110 through the lower intake port 4310 and into a lumen 4413 defined by the PVC tube. The fluid can then travel within the tube assembly 4400 and exit the water gun 4000 via the outtake port 4600, as describe in further detail herein.

FIGS. 15 and 16 illustrate the lower portion 4300 of the water gun 4000 in the second configuration. In the second configuration, the valve cap 4330 is pulled downward relative the water gun 4000. The snap tabs 4332 now engage the lower notches 4323 locking the valve cap 4330 in the second configuration. Similar to the first configuration, the bottom surface of the snap tabs 4332 abut, engage, or otherwise contact the valve cap stop 4324 and prevent the valve cap 4330 from moving in a downward direction beyond the second configuration. This can, for example, prevent damage to and/or disassembly of the water gun 4000. Additionally, while in the second configuration, the upper valve seal 4343 defines a substantially fluid-tight contact and/or seal with the top surface of the sealing protrusions 4326, thereby fluidically separating the valve 4341 from the internal chamber 4110. In this manner, the pump assembly 4500 (shown in FIG. 8) can be configured to define a negative pressure, such that the fluid can be transported from the external fluid reservoir 4700 through the fluid slot 4331 and into the valve openings 4344. The fluid can then travel within the tube assembly 4400 and exit the water gun 4000 via the outtake port 4600, as describe in further detail herein.

Figure 17:
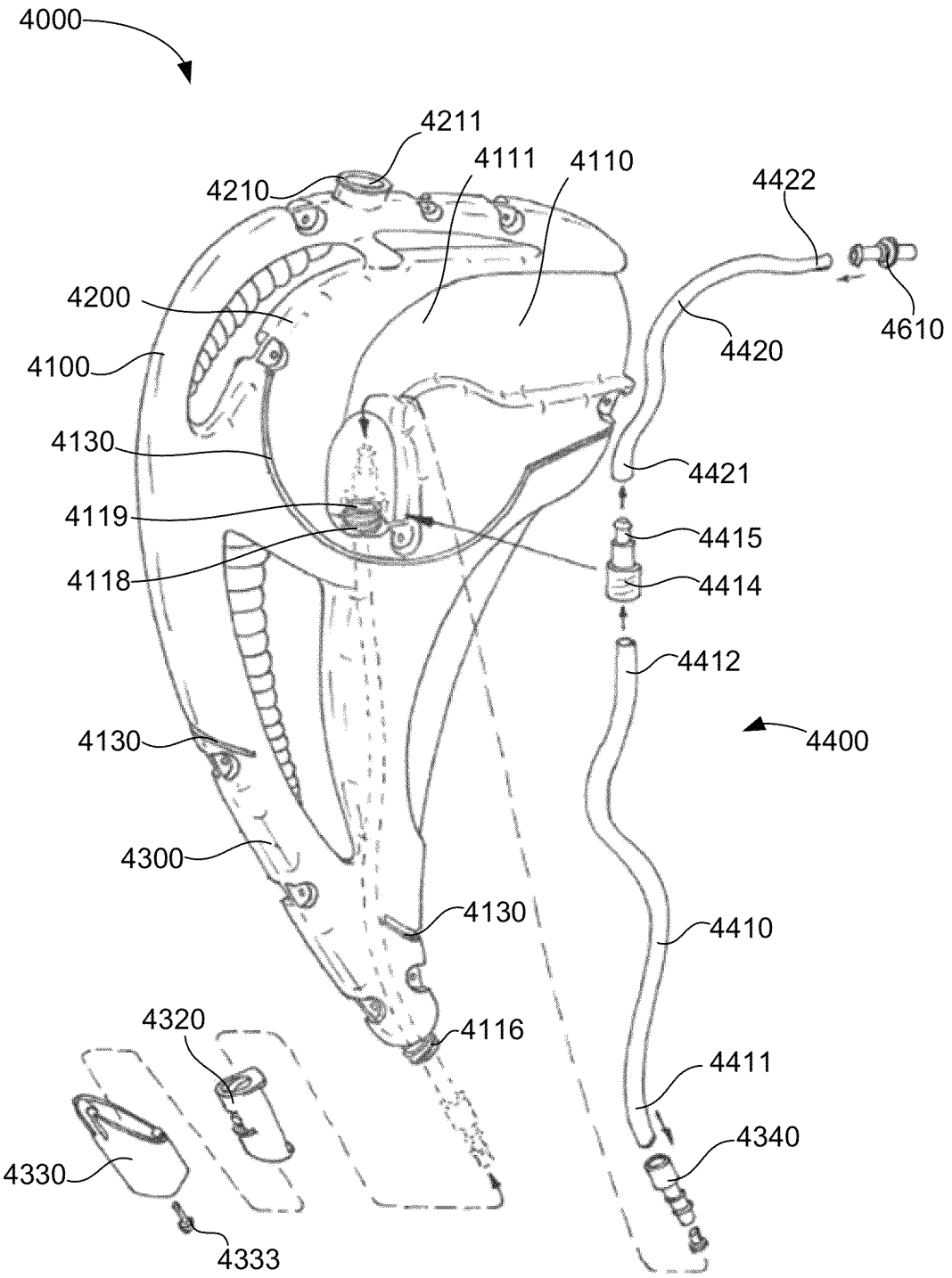
FIG. 17 is an exploded view of the toy water gun of FIG. 6.

Referring now to FIG. 17, the tube assembly 4400 includes the PVC portion 4410 and the flexible tube portion 4420. The tube assembly 4400 also includes an adapter 4414. The recessed portion 4111 of the internal chamber 4110 includes a bottom surface that includes a threaded member 4118 defining an opening 4119. The PVC portion 4410 of the tube assembly 4400 includes a distal end 4412 that couples the threaded member 4118 of the internal chamber 4110. The distal end 4412 can couple the threaded member 4118 in any suitable fashion, such as, for example, with PVC glue, as described above with respect to the proximal end 4411 of the PVC portion 4410 of the tube assembly 4400. The adapter 4414 is configured to be threaded onto the threaded member 4118 of the internal chamber 4110 and includes a flanged end 4415. The flexible tube portion 4420 includes a proximal end 4421 and a distal end 4422. The proximal end 4421 of the flexible tube portion 4420 couples to the flanged end 4415 of the adapter 4414. In some embodiments, the flexible tube 4420 can be secured to the adapter using a hose clamp and/or the like. The distal end 4422 of the flexible tube 4420 couples to a nozzle 4610 included in the outtake port 4600, as described in further detail herein. The arrangement of the tube assembly 4400 and the internal chamber 4110, more specifically the threaded member 4118, provides a fluid flow path for the fluid to flow from the internal chamber 4110 through the tube assembly 4400 and the threaded member 4118 and out of the water gun 4000 via the outtake port 4600.

Figure 18:
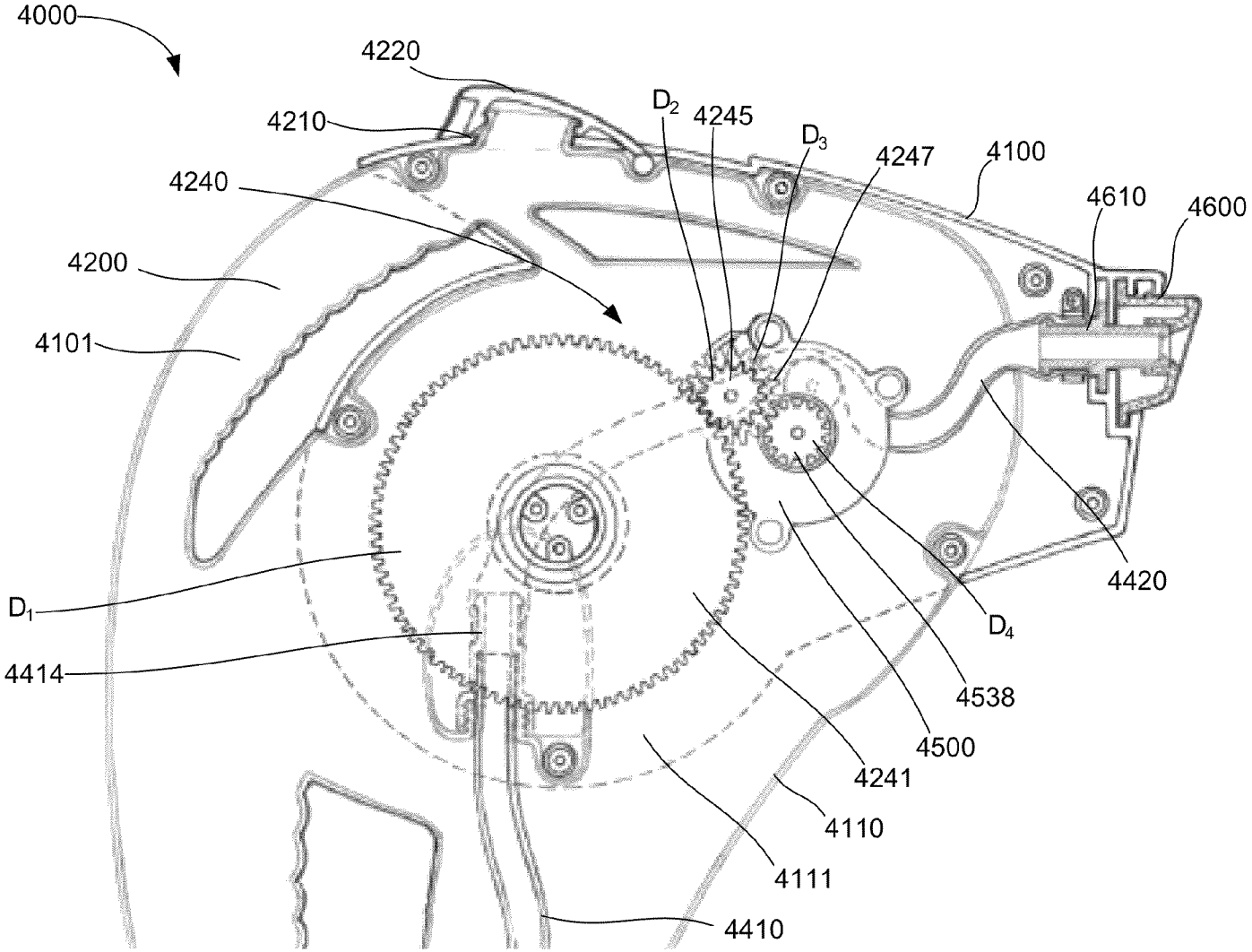
FIG. 18 is a cross-sectional view of the upper portion of the toy water gun of FIG. 6.

FIG. 18 illustrates a cross-sectional view of the upper portion 4200 of the water gun 4000. As described above, the upper portion 4200 includes a gear system 4240. The gear system 4240 includes a drive gear 4241 having a first diameter $D_1$, a first kick-out gear 4245 having a second diameter $D_2$, and a second kick-out gear 4247 having a third diameter $D_3$. The pump assembly 4500 includes a pump cover 4517 that defines a kick-out gear slot 4518 (FIG. 19) through which the first kick-out gear 4245 and the second kick-out gear 4247 couple to the pump assembly 4500. The first kick-out gear 4245 is configured to rest on top of the second kick-out gear 4247 (from the perspective of the side view shown in FIG. 18). In some embodiments, the first kick-out gear 4245 and the second kick-out gear 4247 are independent gears coupled together (e.g., integrally formed, fixedly coupled) in any suitable manner, such as, for example, a mechanical fastener, glue, and/or epoxy. In some embodiments, the first kick-out gear 4245 and the second kick-out gear 4247 are monolithically formed (e.g., a single cast or mold, and/or milled from a single piece of material)

Figure 19:
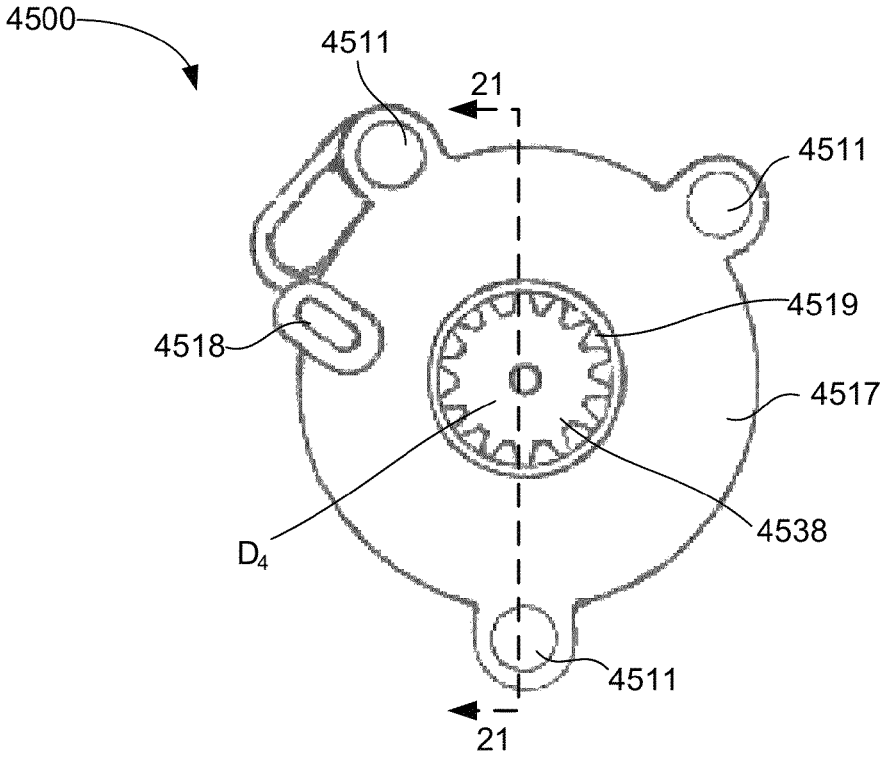
FIGS. 19 and 20 are side views of a peristaltic pump included in the toy water gun of FIG. 6.
Figure 20:
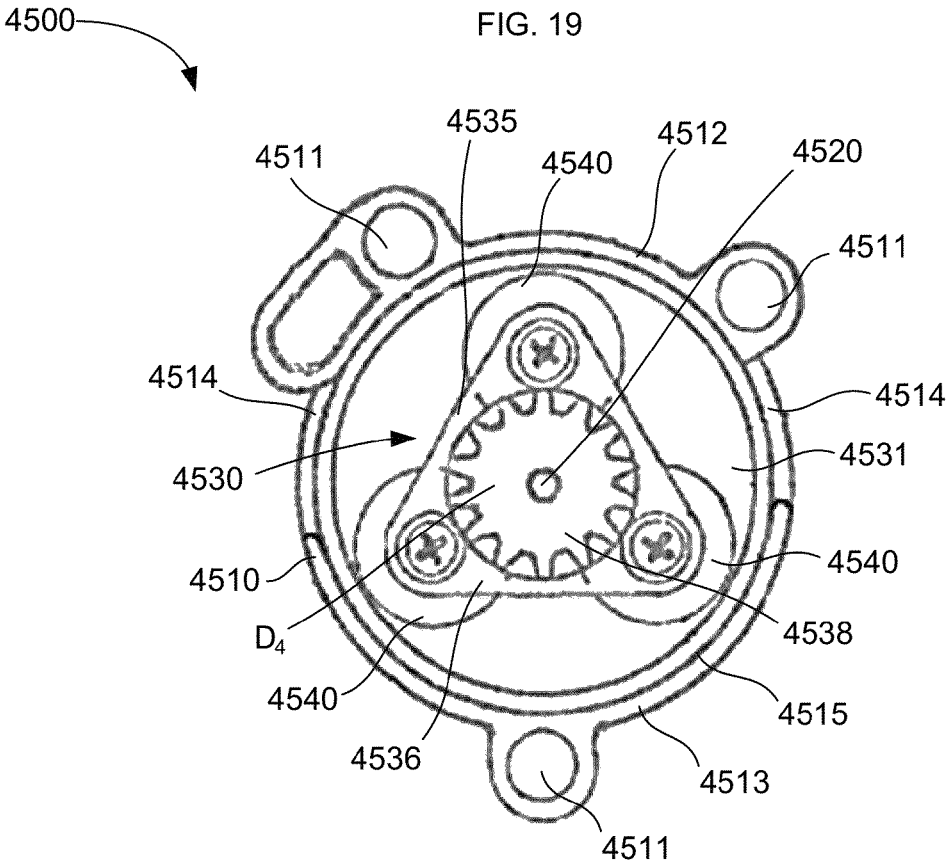
Figure 21:
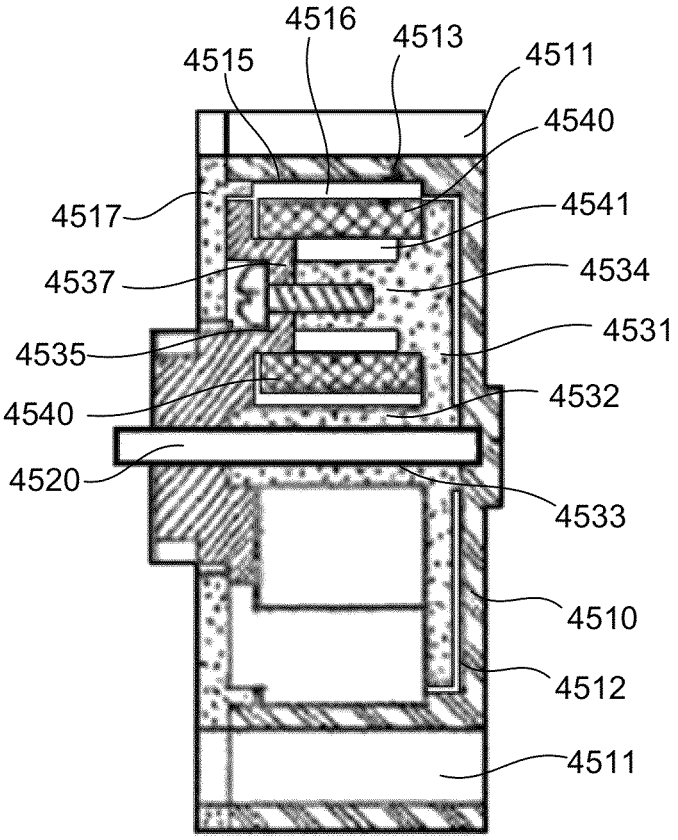
FIG. 21 is a cross-sectional view of the peristaltic pump taken along the line 21-21 in FIG. 19.

Referring now to FIGS. 19-21, the pump assembly 4500 is substantially circular and includes a pump housing 4510, having a base 4512, a set of walls 4513, the pump cover 4517, and a pump axle 4520. The walls 4513 and the pump axle 4520 are configured to extend from the base 4512 of pump housing 4510. Additionally, the pump housing 4510 defines a set of mounting holes 4511 configured to receive a set of mechanical fasteners (e.g., screws, rivets, pins, etc.) that secure the pump assembly 4500 to the housing 4100. While shown in FIG. 20 as defining three mounting holes 4511, the pump housing 4510 can define any suitable number of mounting holes 4511 that can be defined by the pump housing 4510 in any suitable position and/or configuration.

The pump assembly 4500 also includes a roller assembly 4530 having a pump plate 4531, a roller plate 4535, and a set of rollers 4540 (FIGS. 20 and 21). As best shown in FIG. 21, the pump plate 4531 includes a center protrusion 4532 that defines an opening 4533 configured to be fitted over the pump axle 4520, thereby rotatably coupling the roller assembly 4530 to the pump housing 4510. Similarly stated, the pump axle 4520 defines an axis about which the roller assembly 4530 can rotate. The pump plate 4531 also includes a set of roller protrusions 4534 (FIG. 21) that receive the rollers 4540. More specifically, the rollers 4540 each define an annulus with an opening 4541 through which the roller protrusion 4534 is disposed. It should be understood that the plane of the cross-sectional view of FIG. 21 passes through a single roller 4540 and shows the opening 4541 defined by the annular shape of the roller 4540. The roller plate 4535 is disposed on and/or contacts a top surface of the rollers 4540 and includes a set of indentations 4537 that are disposed within the openings 4541. The indentations 4537, being disposed within the openings 4541, can couple the roller protrusion 4534 to the roller plate 4535 using any suitable coupling (e.g., a mechanical fastener such as a screw, rivet, pin, etc.). In this manner, the rollers 4540 can rotate about the roller protrusion 4534 of the pump plate 4531 and the indentation 4537 of the roller plate 4535. While shown in FIGS. 19-21 as including three rollers 4540, the pump assembly 4500 can include any suitable number. In some embodiments, the roller 4540 can be a single roller 4540 with a roller surface that includes dimples, such that the roller 4540 functions similarly to a configuration of multiple rollers 4540. For example, in some embodiments, the roller 4540 can be a single roller and include a surface having three protrusions and defining a dimple, a space, a trough, and/or a void between adjacent protrusions. In such an embodiment, the three protrusions can extend from the roller surface. The roller 4540 can selectively engage the tube assembly 4400, such that the protrusions contact the tube assembly 4400 and a portion of the surface of the roller defining the dimples does not contact the tube assembly 4400.

The pump assembly 4500 also includes a pump gear 4538, having a fourth diameter $D_4$, that extends from a top surface 4536 (FIG. 20) of the roller plate 4535. For example, in some embodiments, the pump gear 4538 is coupled to the roller plate 4535. In other embodiments, the pump gear 4538 is monolithically formed with the roller plate 4535 and protrudes from the top surface 4536. The pump gear 4538 is configured to extend through a pump gear opening 4519 defined by the pump cover 4517. In this manner, the pump gear 4538 can engage the gear system 4240 (FIG. 18) and rotate the roller assembly 4530 (FIG. 20) within the pump housing 4510.

Figure 22:
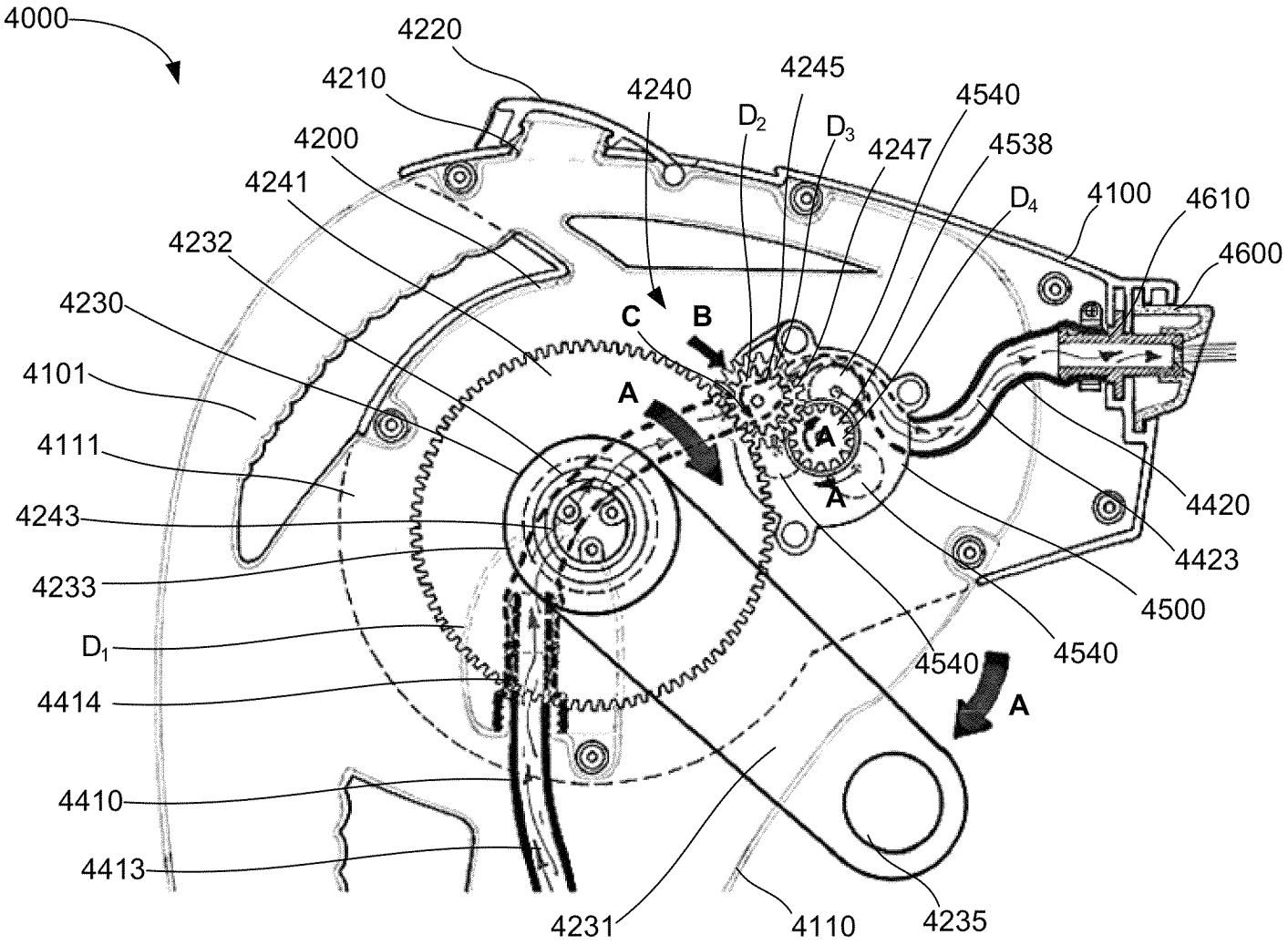
FIG. 22 is a cross-sectional view of the upper portion of the toy water gun of FIG. 6 in use.

As shown in FIG. 22, the drive gear 4241 defines a crank mounting portion 4243 configured to couple to the first end 4232 of the crank arm 4231. The crank arm 4231 can be coupled to the drive gear 4241 using any suitable method, such as, for example, mechanical fasteners (i.e., screws, rivets, pins, etc.). The gear system 4240 is configured to transfer a rotational motion, produced by the user of the water gun 4000 turning the crank 4230, from the crank 4230 to the pump gear 4538, thereby activating the pump assembly 4500. More specifically, the user can introduce a rotational motion in the direction of the arrow A and thus, rotate the drive gear 4241 in the same direction. The drive gear 4241 meshes (i.e., interlocks and/or rotationally couples) with the first kick-out gear 4245 and rotates the first kick-out gear 4545 and the second kick-out gear 4247 in the direction of the arrow C. The rotational force between the drive gear 4141 and the first kick-out gear 4245 generates a linear force in the direction of the arrow B that can cause the first kick-out gear 4245 and the second kick-out gear 4247 to slide within the kick-out gear slot 4518 (FIG. 19) in the direction of the arrow B. Additionally, the linear force generated by transferring the rotational motion between the drive gear 4241 and the first kick-out gear 4245 maintains the kick-out gears in the forward position within the kick-out gear slot 4518. As such, the second kick-out gear 4247 can then engage the pump gear 4538, thereby rotating the pump gear 4538 in the direction of the arrow A. The diameters $D_1$, $D_2$, $D_3$, and $D_4$ can be any suitable size, such as, for example, 91 mm, 17 mm, 24 mm, and 17 mm, respectively, and thereby can produce a desired gear ratio. For this example, the gear system 4240 and the pump gear 4538 defines a 1:9 gear ratio. Similarly stated, the diameters of the drive gear 4241, the first kick-out gear 4245, the second kick-out gear 4247, and the pump gear 4538 defines a gear ratio such that, the pump gear 4538 rotates 9 times for every complete rotation of the drive gear 4241. In some embodiments, the gear ratio can be in a range, for example, between 1:9 and 1:12.

Figure 23:
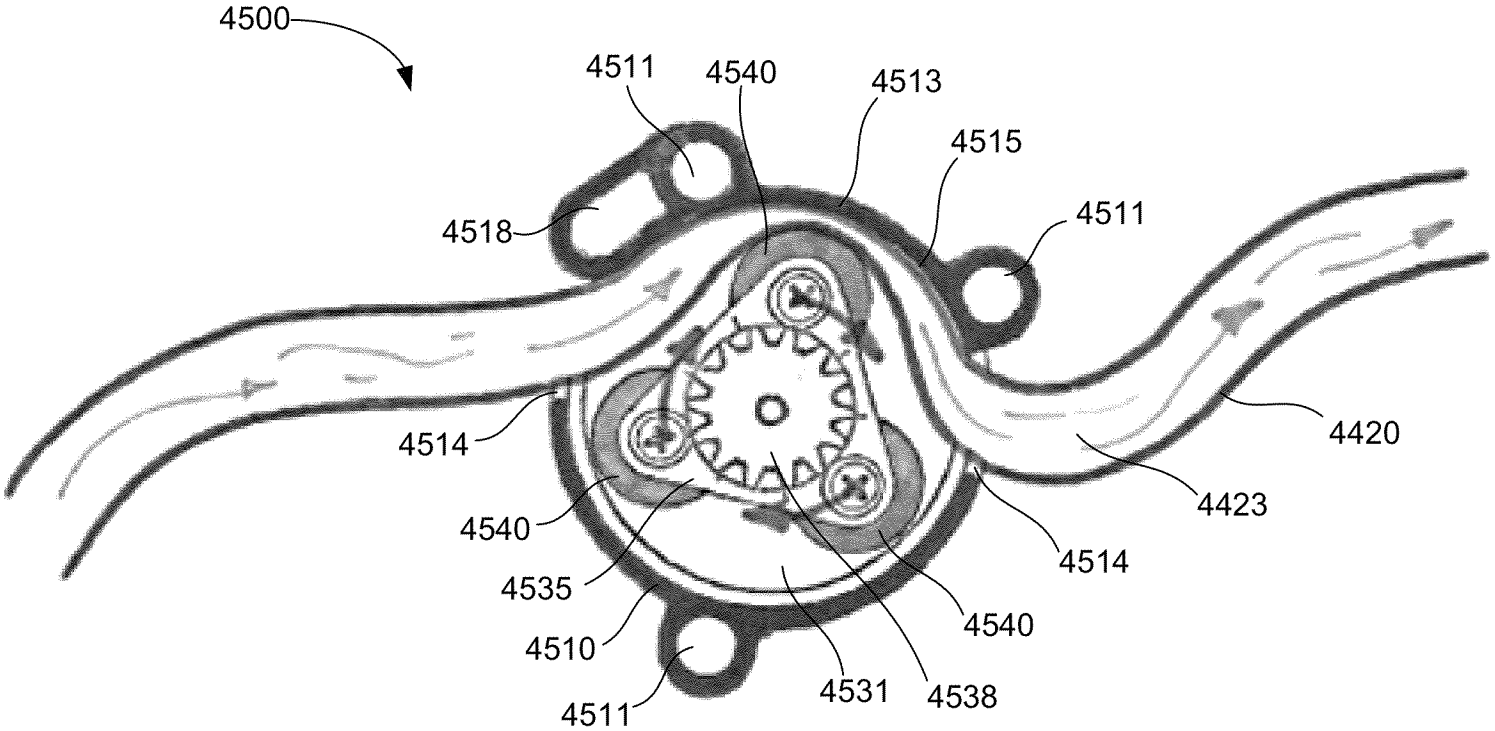
FIG. 23 is a side view of the peristaltic pump of FIG. 19 in use.

The rotation of the pump gear 4538 by the second kick-out gear 4247 (FIG. 18) introduces a rotational motion to the roller assembly 4530 disposed within the pump housing 4510, as shown in FIG. 23. As described above, the tube assembly 4400 includes the flexible tube portion 4420. At least a portion of the flexible tube portion 4420 is configured to be disposed within the pump housing 4510. More specifically, the pump housing 4510 includes a set of tube openings 4514, through which a portion of the flexible tube 4420 can pass. The flexible tube 4420 is disposed within a cavity 4516 (FIG. 21) defined by an internal surface 4515 of the walls 4513 and at least one roller 4540. In this manner, the rollers 4540 selectively engage (e.g., squeeze) the flexible tube 4420 in a peristaltic motion. The peristaltic motion defines a negative pressure within a lumen 4423 defined by the flexible tube 4420 between the higher pressure in the lumen 4423 before entering the pump assembly 4500 and the lower pressure in the lumen 4423 after exiting the pump assembly 4500. Thus, when the user turns the crank 4230 in the direction of the arrow A (FIG. 22), a suction force exists within the tube assembly 4400 such that the fluid is transferred through the valve 4341 (FIGS. 13-16) included in the lower intake port 4310 and into the tube assembly 4400. Additionally, the peristaltic motion of the rollers 4540 engaging the flexible tube 4420 defines a force that pushes the fluid flowing within the portion of the lumen 4423 of the flexible tube 4420 that has exited the pump assembly toward the outtake port 4600.

Figure 24:
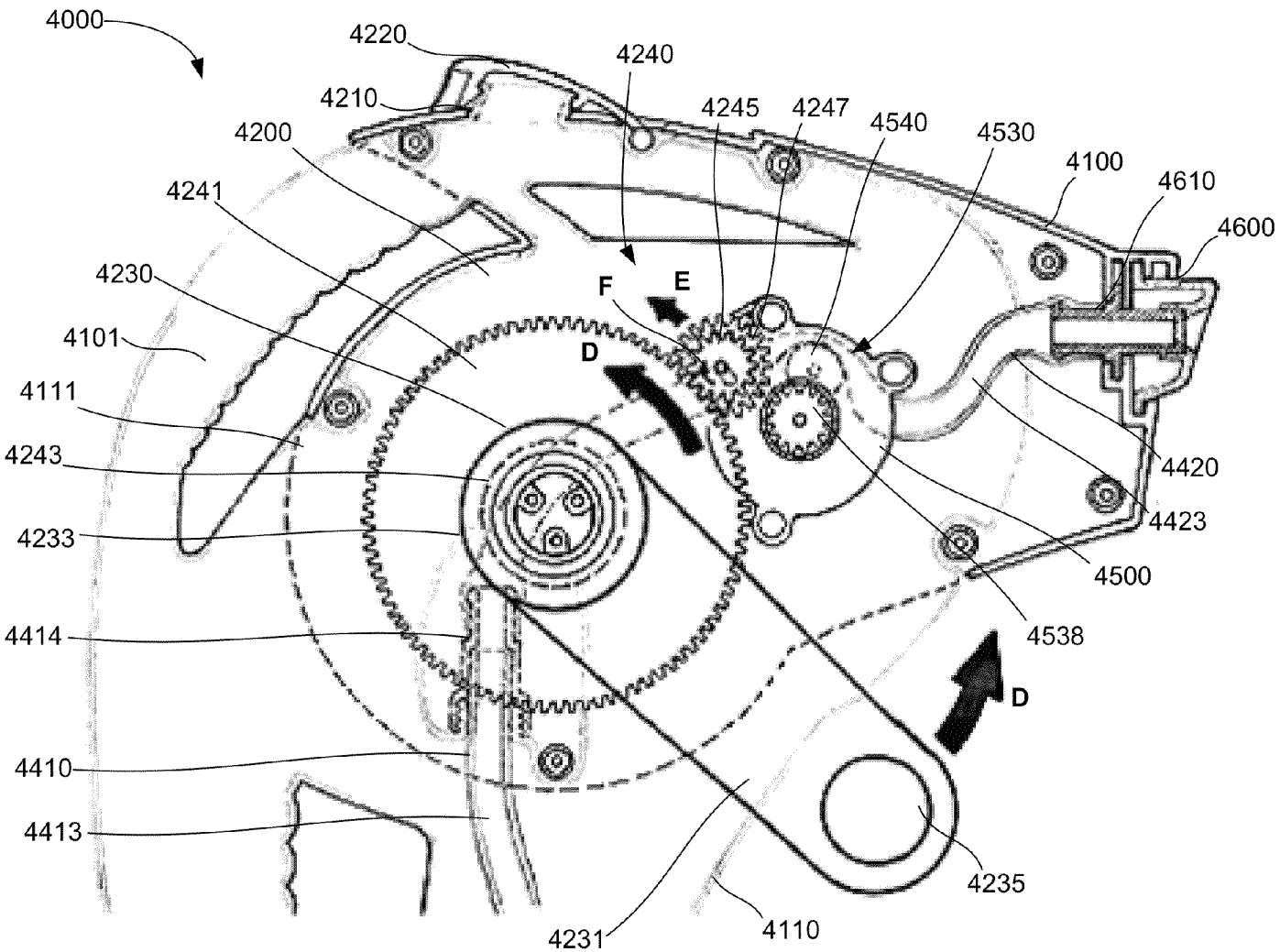
FIG. 24 is a cross-sectional view of the upper portion of the toy water gun of FIG. 6 in use.

As shown in FIG. 24, if the user introduces a rotational motion in the direction of the arrow D (i.e., the opposite direction of the arrow A of FIG. 22), the drive gear also rotates in the direction of the arrow D. The drive gear 4241 meshes (i.e., interlocks and/or rotationally couples) with the first kick-out gear 4245 and rotates the first kick-out gear 4545 and the second kick-out gear 4247 in the direction of the arrow F. The rotational force between the drive gear 4141 and the first kick-out gear 4245 generates a linear force in the direction of the arrow E that can cause the first kick-out gear 4245 and the second kick-out gear 4247 to slide within the kick-out gear slot 4518 (FIG. 19) in the direction of the arrow E. Additionally, the linear force generated by transferring the rotational motion between the drive gear 4241 and the first kick-out gear 4245 maintains the kick-out gears 4245 and 4247 in the rearward position within the kick-out gear slot 4518. As such, the second kick-out gear 4247 does not engage the pump gear 4538. The arrangement of the first kick-out gear 4245 and second kick-out gear 4247 and the kick-out gear slot 4518 of the pump cover 4517 collectively prevent the roller assembly 4530 from rotating in a reverse direction and thus, prevent the pressure drop and ensuing fluid flow, described above, from occurring in the opposite direction.

Figure 25:
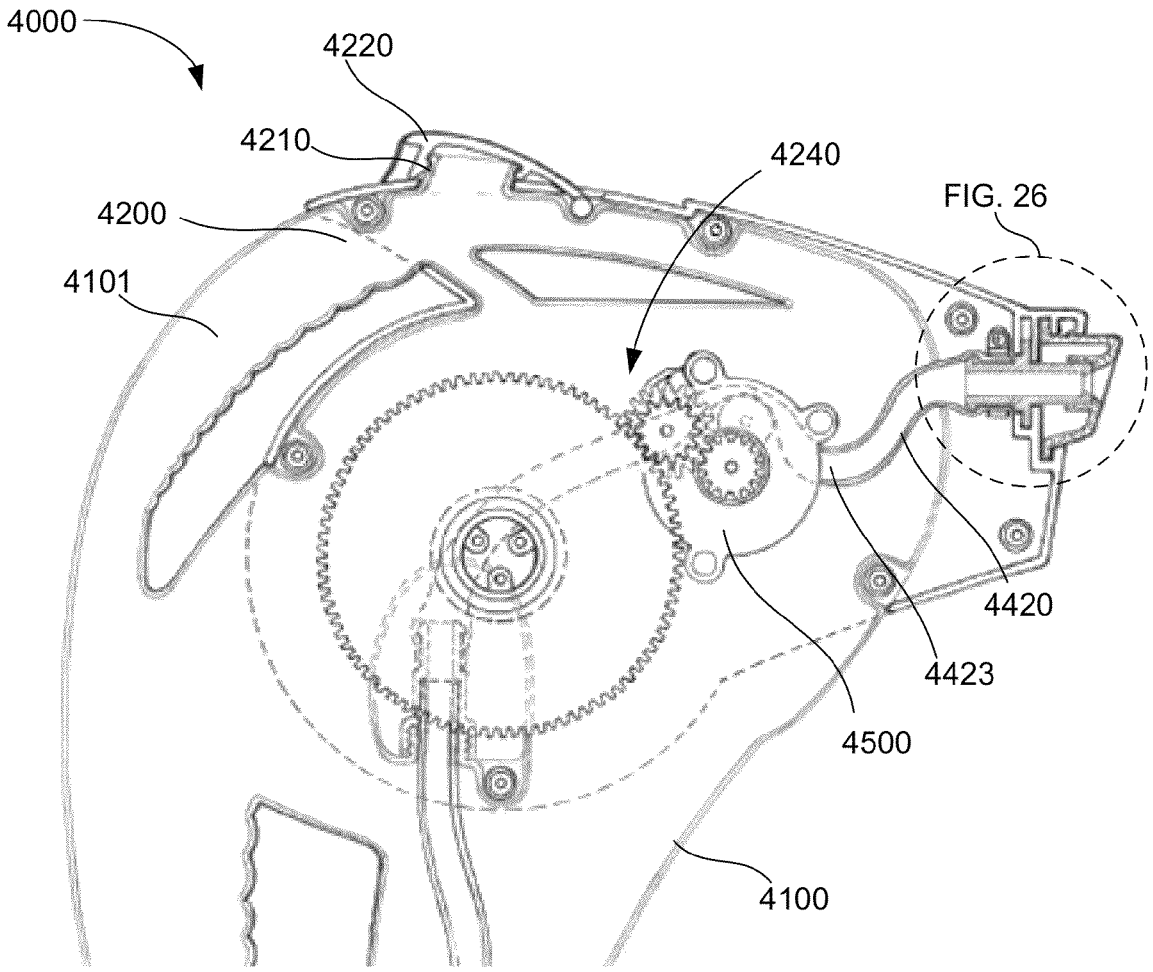
FIG. 25 is a cross-sectional view of the upper portion of the toy water gun of FIG. 6.
Figure 26:
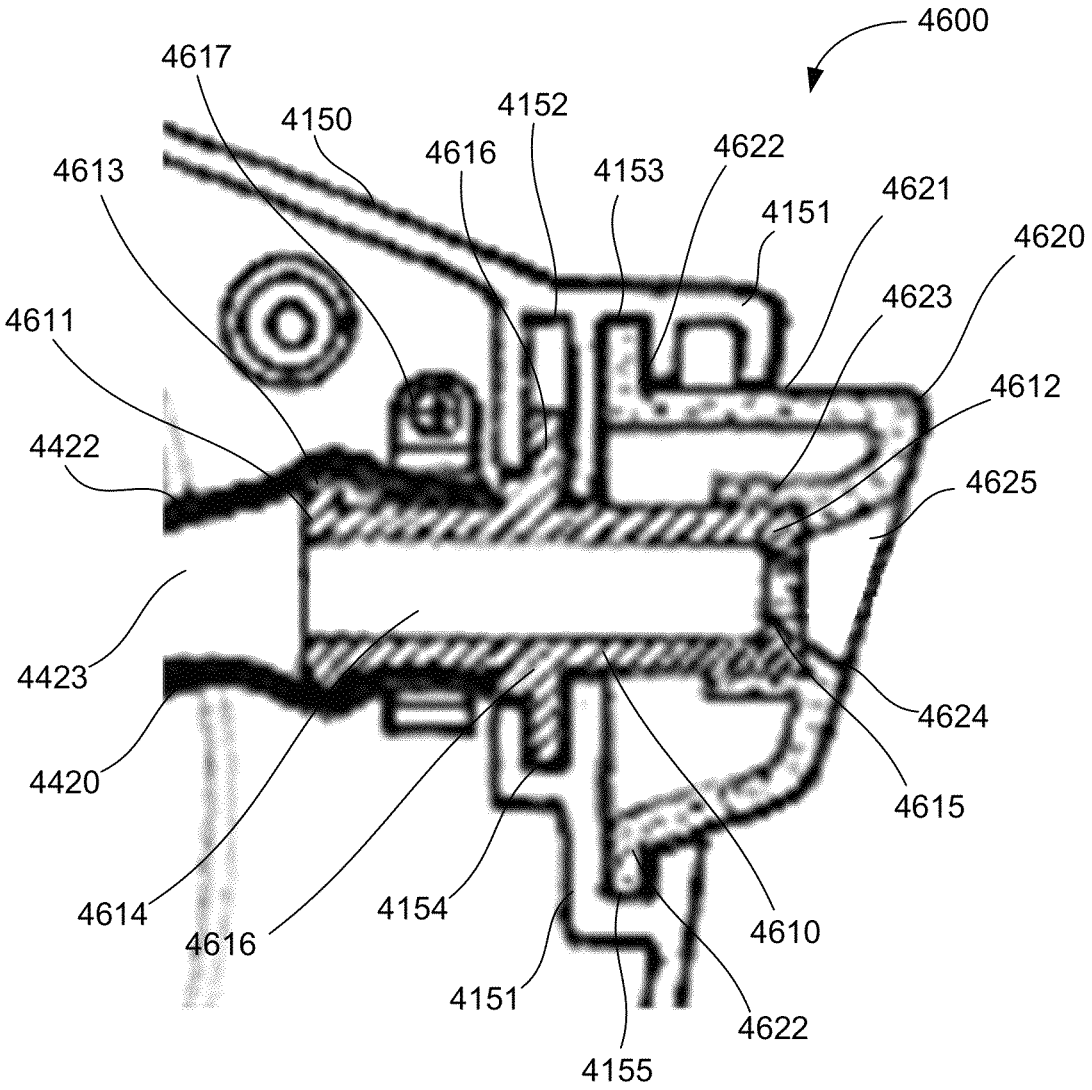
FIG. 26 is an enlarged cross-sectional view of an outtake portion represented by circle FIG. 26 in FIG. 25.
Figure 27:
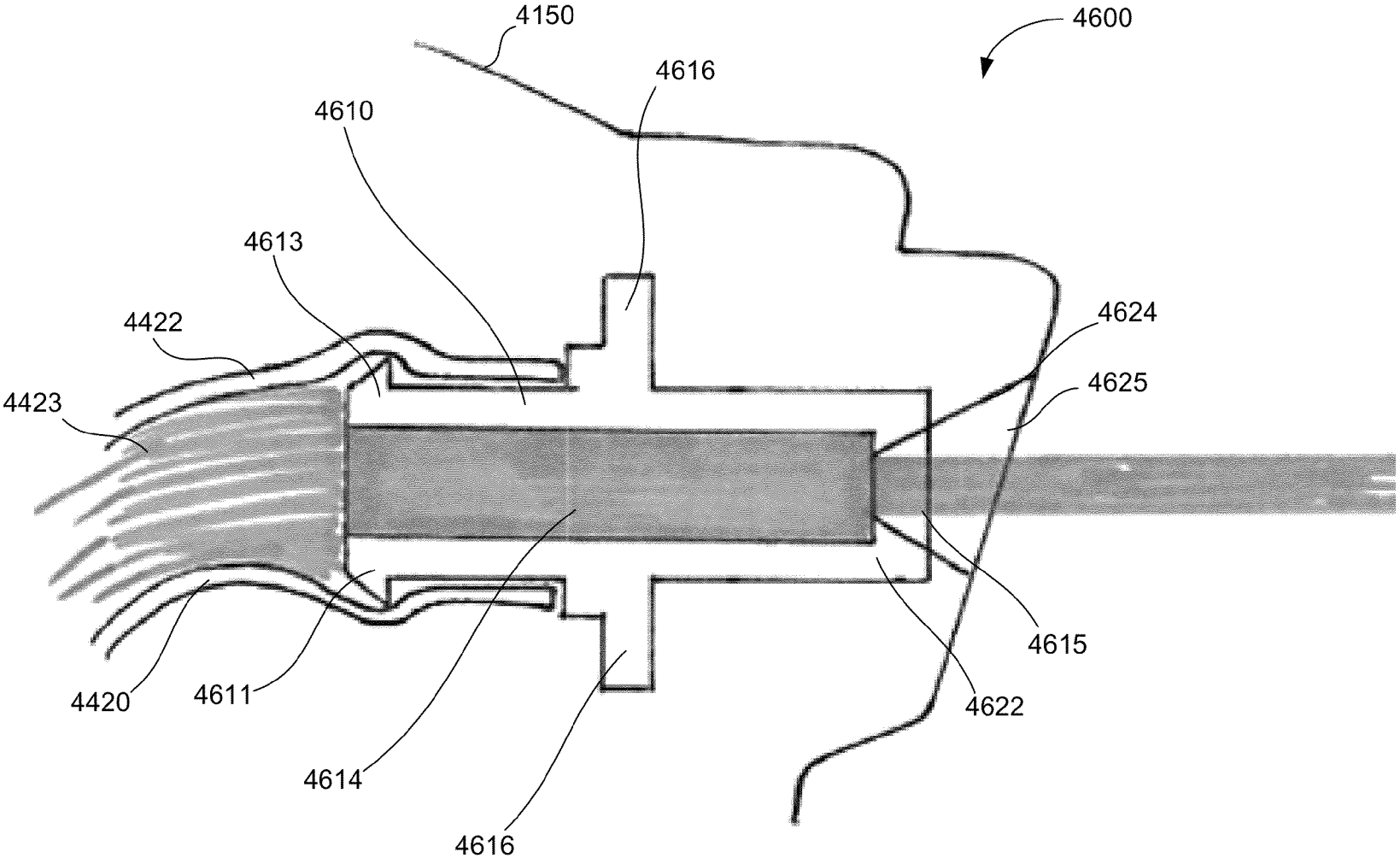
FIG. 27 is a cross-sectional view of the outtake portion of FIG. 18 in use.
Figure 28:
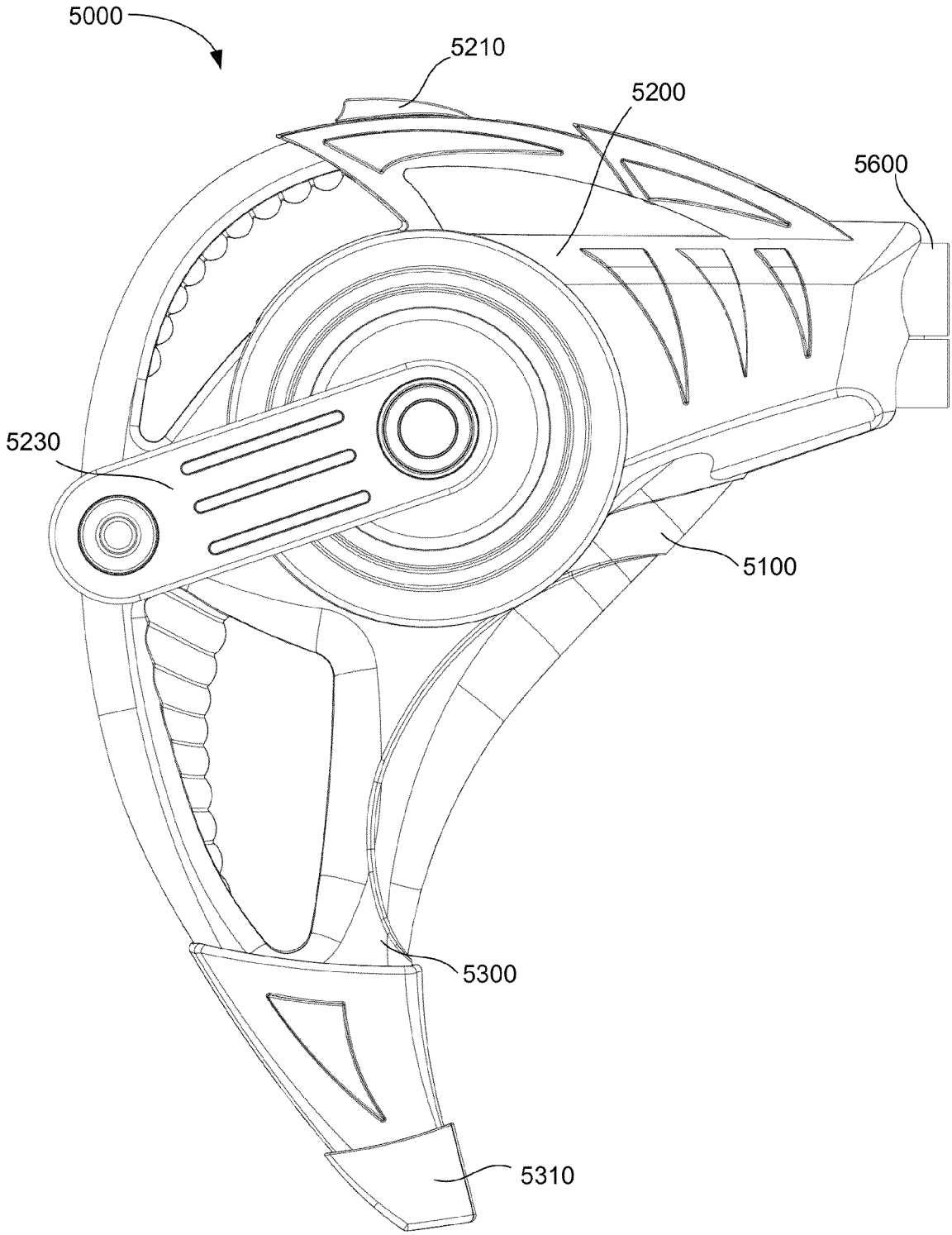
FIG. 28 is a right side view of a toy water gun, according to an embodiment.

Referring to FIGS. 25-27, the upper portion 4200 of the water gun 4000 includes the outtake portion 4600. The outtake portion 4600 is configured to transfer a fluid flow within the lumen 4423 defined by the flexible tube 4420 to a volume substantially outside the water gun 4000. As shown in the enlarged view of FIG. 26, the outtake port 4600 includes a nozzle 4610 and an outtake cap 4620. The housing 4100 include an outtake portion 4150 that includes a set of protrusions 4151 that define multiple slots. More specifically, the set of protrusions 4151 define an upper nozzle slot 4152 and an upper cap slot 4153, and a lower nozzle slot 4154 and a lower cap slot 4155. The nozzle 4610 includes a first end 4611 and a second end 4612 and defines a lumen 4614 therethrough. The first end 4611 includes a flanged portion 4613 and is configured to be inserted into the distal end 4422 of the flexible tube 4420. The distal end 4422 of the flexible tube 4420 can be secured (i.e., fixedly coupled) to the first end 4611 of the nozzle 4610 using any appropriate method or component including, for example, a glue, adhesive, etc. For another example, the distal end 4422 of the flexible tube 4420 can be secured (e.g., fixedly coupled) to the first end 4611 of the nozzle 4610 using mounting clamp 4617. The mounting clamp 4617 can also couple the first end 4611 of the nozzle 4610 to the housing 4100. The nozzle 4610 can also include a mounting flange 4616 configured to be disposed within the upper nozzle slot 4152 and the lower nozzle slot 4154. In some embodiments, the nozzle 4610 can include multiple mounting flange 4616 that can be any suitable size, shape, or configuration.

The outtake cap 4620 includes and outer surface 4621, having a mounting flange 4622. The mounting flange 4622 is configured to be disposed within the upper cap slot 4153 and the lower cap slot 4155, as similarly described above. In this manner, the upper cap slot 4153, the lower cap slot 4155, and the mounting flange 4522 collectively removably couple the outtake cap 4620 to the outtake portion 4150 of the housing 4100. The outtake cap 4620 also includes a nozzle receiving portion 4623 that receives the second end 4612 of the nozzle 4610. The arrangement of outtake portion 4150 of the housing 4100, the nozzle 4610, and the outtake cap 4620 secures (e.g., fixedly couples) the outtake port 4600 to the housing 4100.

The second end 4612 of the nozzle 4610 includes an outlet 4615 (FIGS. 26 and 27). The outlet 4615 is a substantially tapered shape and includes sharp edges, such that the fluid flowing through the lumen 4614, exits the nozzle 4610, via the outlet 4615, in a substantially straight stream. Furthermore, the arrangement of the outlet 4615 and the operating of the pump assembly 4500 allows the fluid flow to travel a distance from the water gun 4000.

Referring now to FIGS. 28-36, a toy water gun 5000 includes a housing 5100, having an upper portion 5200 a lower portion 5300 and an outtake port 5600, and pump assembly 5500. As shown in FIGS. 28-33, the toy water gun 5000 can define any suitable shape, size, or configuration. In some embodiments, some aspects of the toy water gun 5000 can be substantially similar in form and function to aspects of the toy water gun 4000, described above with reference to FIGS. 6-27. Thus, such details are not described in further detail herein and should be considered substantially similar. Furthermore, it should be understood that some changes can be made to such aspects without substantially changing the function or overall form.

The housing 5100 is configured to define an internal chamber 5110 and encase at least a gear system 5240, a tube assembly 5400, and a pump assembly 5500. Moreover, the upper portion 5200 of the housing 5100 includes an upper intake port 5210 fluidically coupled to the internal chamber 5110 and is configured to receive a fluid therethrough. In this manner, the internal chamber 5110 is configured to house, store, contain, or otherwise include a fluid. The internal chamber 5110 includes a recessed portion 5111 configured to provide room for the gear system 5240, a portion of the tube assembly 5400, and the pump assembly 5500, as shown, for example, in FIG. 35.

The upper portion 5200 further includes the outtake port 5600 and a crank 5230. In some embodiments, the outtake port 5600 is monolithically formed with the upper portion 5200 of the housing 5100. In other embodiments, the outtake port 5600 is fluidically coupled to the upper portion 5200 of the housing 5100 (e.g., formed from a separate piece of material and assembled such as to be in fluid communication with the upper portion 5200 of the housing 5100). The crank 5230 can be substantially similar in form and function to the crank 4230 (described above with reference to FIG. 6-27) and is coupled to a portion of the gear system 5240. In this manner, the crank 5230 can rotate relative to the housing 5100 and is operative in actuating the pump assembly 5500, as further described below.

Figure 33:
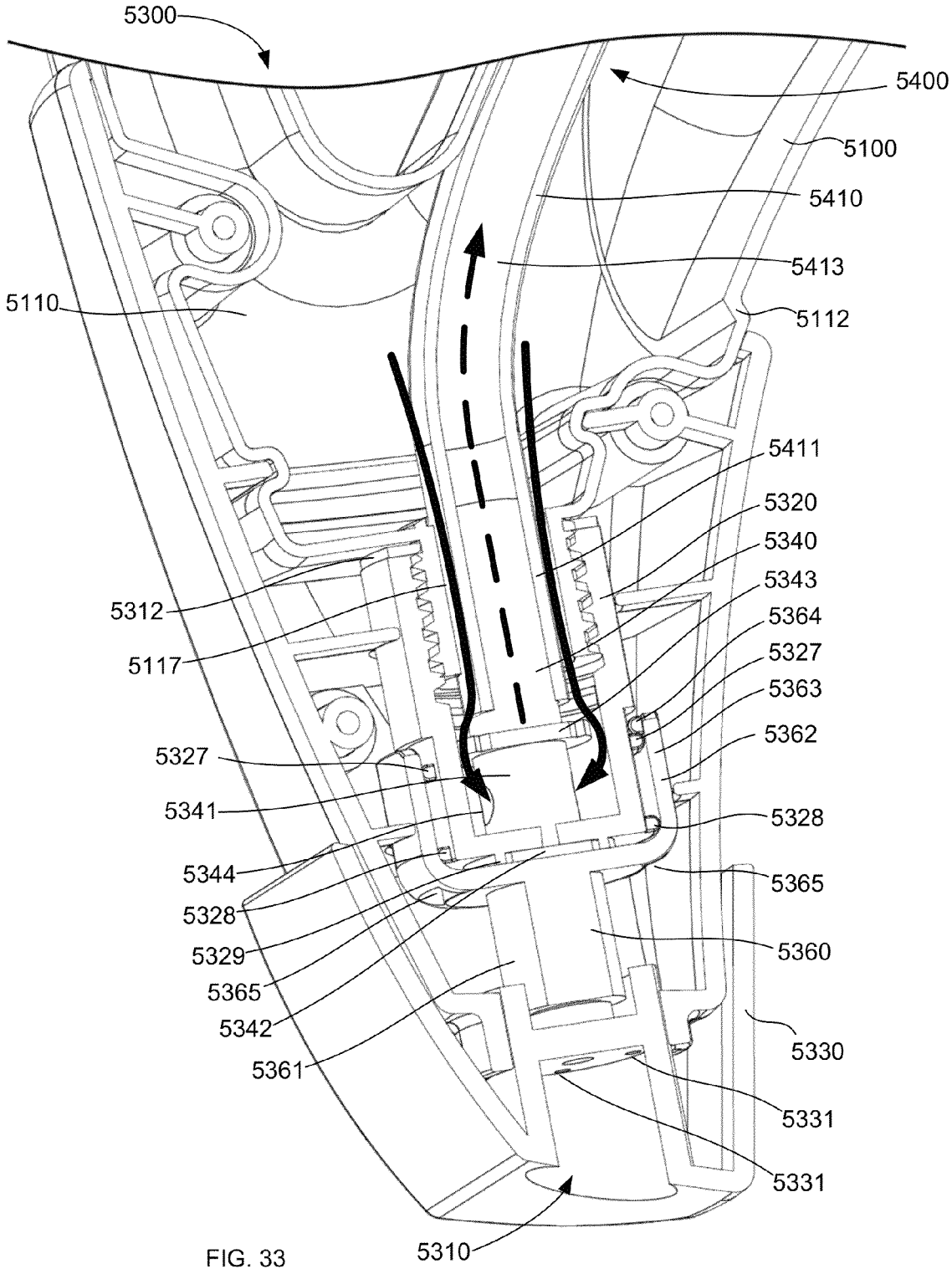
FIG. 33 is an enlarged cross-sectional view of a lower portion of the toy water gun of FIG. 28, in a first configuration.
Figure 34:
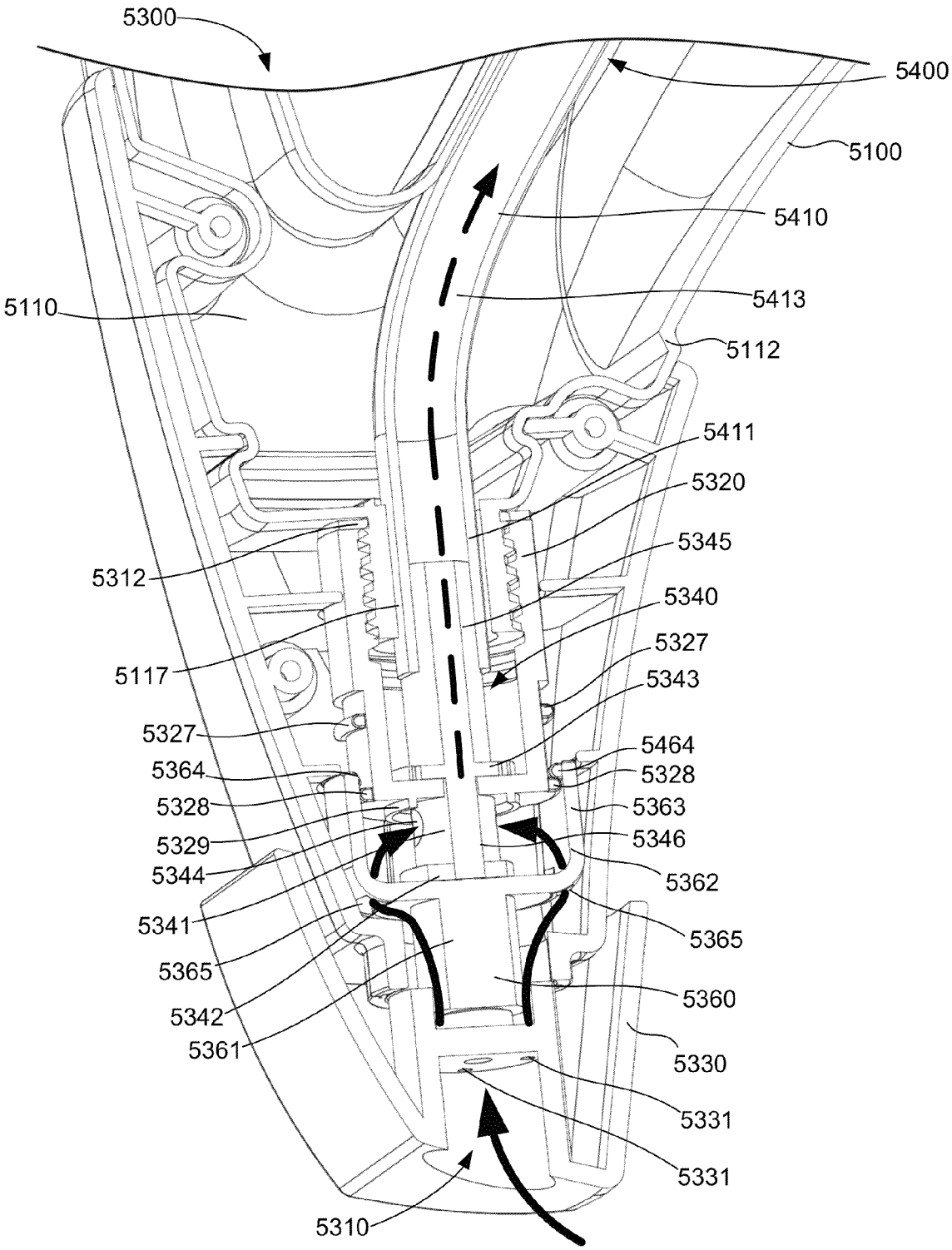
FIG. 34 is an enlarged cross-sectional view of the lower portion of the toy water gun of FIG. 28, in a second configuration.

FIGS. 33 and 34 illustrate the lower portion 5300 of the water gun 5000 in a first configuration and a second configuration, respectively. The lower portion 5300 includes a lower intake port 5310, a valve guide 5320, a valve cap 5330, and a valve assembly 5340 that are collectively configured to receive a portion of a fluid. As shown in FIG. 33, the valve guide 5320 is coupled to a set of walls 5112 defining the internal chamber 5110 via a threaded coupling. In other embodiments, the valve guide 5320 can be coupled to the internal chamber 5110 in any suitable manner (e.g., with an adhesive). A sealing member 5312 is disposed on a top surface of the valve guide 5320 and can engage the walls 5112 defining the internal chamber 5110 to form a substantially fluid-tight seal. Similarly stated a fluid, disposed within the internal chamber 5110, is substantially isolated from a volume outside of the internal chamber 5110 and/or the valve guide 5320. The valve cap 5330 and the valve assembly 5340 selectively engage the valve guide 5320 such that the water gun can move between the first configuration (FIG. 33) and the second configuration (FIG. 34).

The valve guide 5320 includes an upper protrusion 5327 and a lower protrusion 5328. In some embodiments, the upper protrusion 5327 and the lower protrusion 5328 are annular protrusions configured to substantially circumscribe an outer surface of the valve guide 5320. The valve guide 5320 further includes a valve seal seat 5329 configured to receive a lower valve seal 5342 included in the valve assembly 5340.

The valve actuator 5360 includes a lower portion 5361 and an upper portion 5362. The lower portion 5361 is configured to be coupled to the valve cap 5330. In some embodiments, the lower portion 5361 can be coupled to the valve cap 5330 via a threaded coupling. In other embodiments, the lower portion 5361 can be coupled to the valve cap in any suitable manner, such as, a snap fitting, a press or friction fit, an adhesive, a mechanical fastener (e.g., a screw), or the like. The upper portion 5362 of the valve actuator 5360 includes a set of walls 5363. As shown in FIG. 33, the walls 5363 of the upper portion 5362 of the valve actuator 5360 can be annular walls and be configured to receive a portion of the valve guide 5320 therebetween. Furthermore, the walls 5363 define a set of openings 5365 and include a protrusion 5364 configured to extend inward from the walls 5363 of the valve actuator 5360. In this manner, the protrusion 5364 can selectively engage the upper protrusion 5327 or the lower protrusion 5328 of the valve guide 5320 when the lower portion 5300 of the water gun 5000 is moved between the first configuration and the second configuration, respectively.

As described above, the valve cap 5330 is coupled to the valve actuator 5360. The valve cap 5330 includes the lower intake port 5310 and defines a set of openings 5331. The openings 5331 can be any suitable shape, size, or configuration. Furthermore, the valve cap 5330 can define any suitable number of openings 5331. For example, while shown in FIGS. 33 and 34 as including a set of openings 5331, in some embodiments, the valve cap 5330 can define a single annular opening of any suitable size. The valve cap 5330 is configured to be slidably coupled to the lower portion 5300 of the water gun 5000 such that the valve cap 5330 can be engaged by a user to the move the lower portion 5300 of the water gun 5000 between the first configuration and the second configuration.

The valve assembly 5340 includes a valve 5341, the lower valve seal 5342, an upper valve seal 5343, and the valve actuator 5360. The valve 5341 includes an upper portion 5345 and a lower portion 5346. The upper portion 5345 is configured to be coupled to a proximal end 5411 of the PVC portion 5410 of the tube assembly 5410. The proximal end 5411 of the PVC portion 5410 can be coupled to the upper portion 5345 of the valve 5341 in any suitable manner such as, for example, those described above with respect to FIGS. 14 and 15. The lower portion 5346 of the valve 5341 defines a set of openings 5344 and can be coupled to the valve actuator 5360, as described in further detail herein.

The lower valve seal 5342 and the upper valve seal 5343 can be any suitable seal members. For example, as shown in FIGS. 33 and 34, the lower valve seal 5342 and the upper valve seal 5343 are annular seal members such as o-rings. In this manner, the lower valve seal 5342 and the upper valve seal 5343 are configured to be disposed about the lower portion 5346 of the valve 5341 such that the openings 5344 defined by the lower portion 5346 are disposed in the space between the lower valve seal 5342 and the upper valve seal 5343. Similarly stated, the lower valve seal 5342 is disposed about the lower portion 5346 of the valve 5341 below the openings 5344 and the upper valve seal 5343 is disposed about the lower portion 5346 of the valve 5341 above the openings 5344.

In use, the lower valve seal 5342 and the upper valve seal 5343 can selectively engage a bottom portion of the valve guide 5320 to define a substantially fluid-tight contact and/or seal with the bottom portion of the valve guide 5320. When the lower portion 5300 of the water gun 5000 is in the first configuration, the lower valve seal 5342 is disposed within the valve seal seat 5329 included in the valve guide 5320. While in the first configuration, the valve openings 5344 are in fluid communication with the internal chamber 5110 and can receive a portion of fluid disposed therein. In this manner, the pump assembly 5500 (shown in FIG. 35) can be configured to define a negative pressure, such that the fluid can be transported from the internal chamber 5110 through the tube assembly 5400 and exit the water gun 5000 via the outtake port 5600. Furthermore, with the lower valve seal 5342 disposed within the valve seal seat 5329 the portion of the valve 5341 (e.g., the portion of the valve 5341 disposed within the valve guide 5320 is fluidically isolated from a portion outside the valve guide 5320. Similarly stated, in the first configuration, the valve 5341 is in a first position such that the openings 5344 are in fluid communication with a volume defined within the internal chamber 5110 and/or the valve guide 5320 and fluidically isolated from a volume outside the internal chamber 5110 and/or the valve guide 5320.

While in first configuration, the valve actuator 5360 is disposed such that the protrusion 5364 included in the walls 5363 of the upper portion 5362 is in contact with the upper protrusion 5327 of the valve guide 5320. More specifically, the protrusion 5364 is disposed on a top surface of the upper protrusion 5327, thereby maintaining the lower portion 5300 of the water gun 5000 in the first configuration.

As shown in FIG. 34, a user can move the valve cap 5330 in a downward direction to move the lower portion 5300 of the water gun 5000 to the second configuration. The downward motion of the valve cap 5330 urges the valve assembly 5360 to also move in the downward direction. More specifically, the valve actuator 5360 is moved to disengage the upper protrusion 5327 of the valve guide 5320 such that the valve actuator 5360 moves in the downward direction. With the lower portion 5346 of the valve 5341 coupled to the valve actuator 5360, the valve 5341 also moves in the downward direction. In this manner, the protrusion 5364 is placed in contact with the lower protrusion 5328 of the valve guide 5320 and the lower portion 5300 is placed in the second configuration.

While in the second configuration, the lower portion 5346 of the valve 5341 is disposed relative to the valve guide 5320 such that the openings 5344 defined by the valve 5341 are below the bottom portion of the valve guide 5320. Moreover, the upper valve seal 5343 is placed in contact with the bottom portion of the valve guide 5320 and defines a fluid tight seal, thereby fluidically isolating the volume within the internal chamber 5110 and/or the valve guide 5320 from the openings 5344 of the valve 5341. In this manner, the lower portion 5300 of the water gun 5000 can be placed within an external fluid source and the pump assembly 5500 (shown in FIG. 35) can be configured to define a negative pressure, such that a fluid within the external fluid source is transported through the openings 5331 defined by the valve cap 5330. In addition, the negative pressure exerted by the pump assembly 5500 transports a portion of the fluid through the openings 5365 defined by the valve actuator 5360 and through the openings 5344 defined by the valve 5341. Thus, the portion of the fluid can be transported from the external fluid source through the tube assembly 5400 and exit the water gun 5000 via the outtake port 5600.

Figure 35:
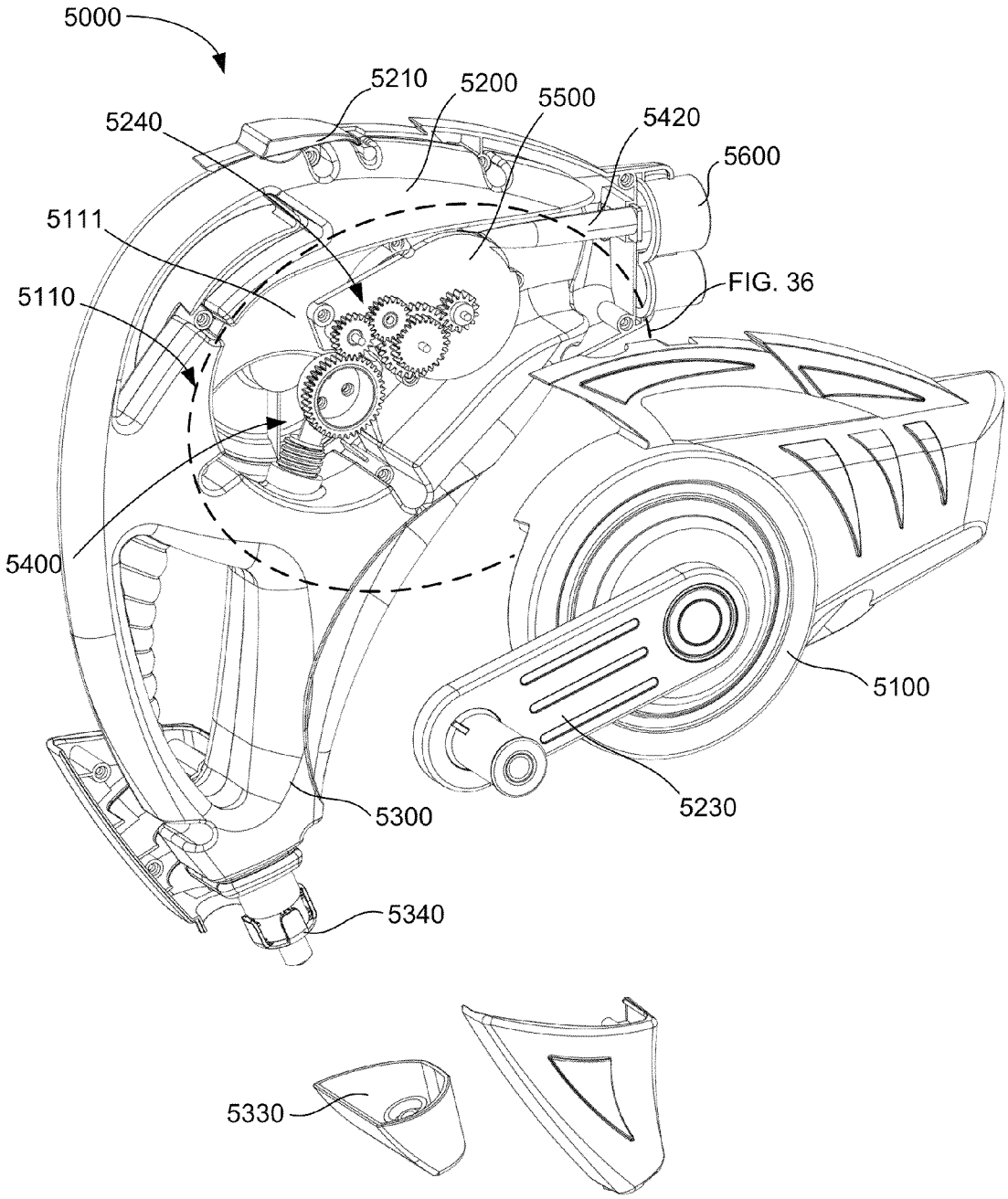
FIG. 35 is an exploded view of the toy water gun of FIG. 28.
Figure 36:
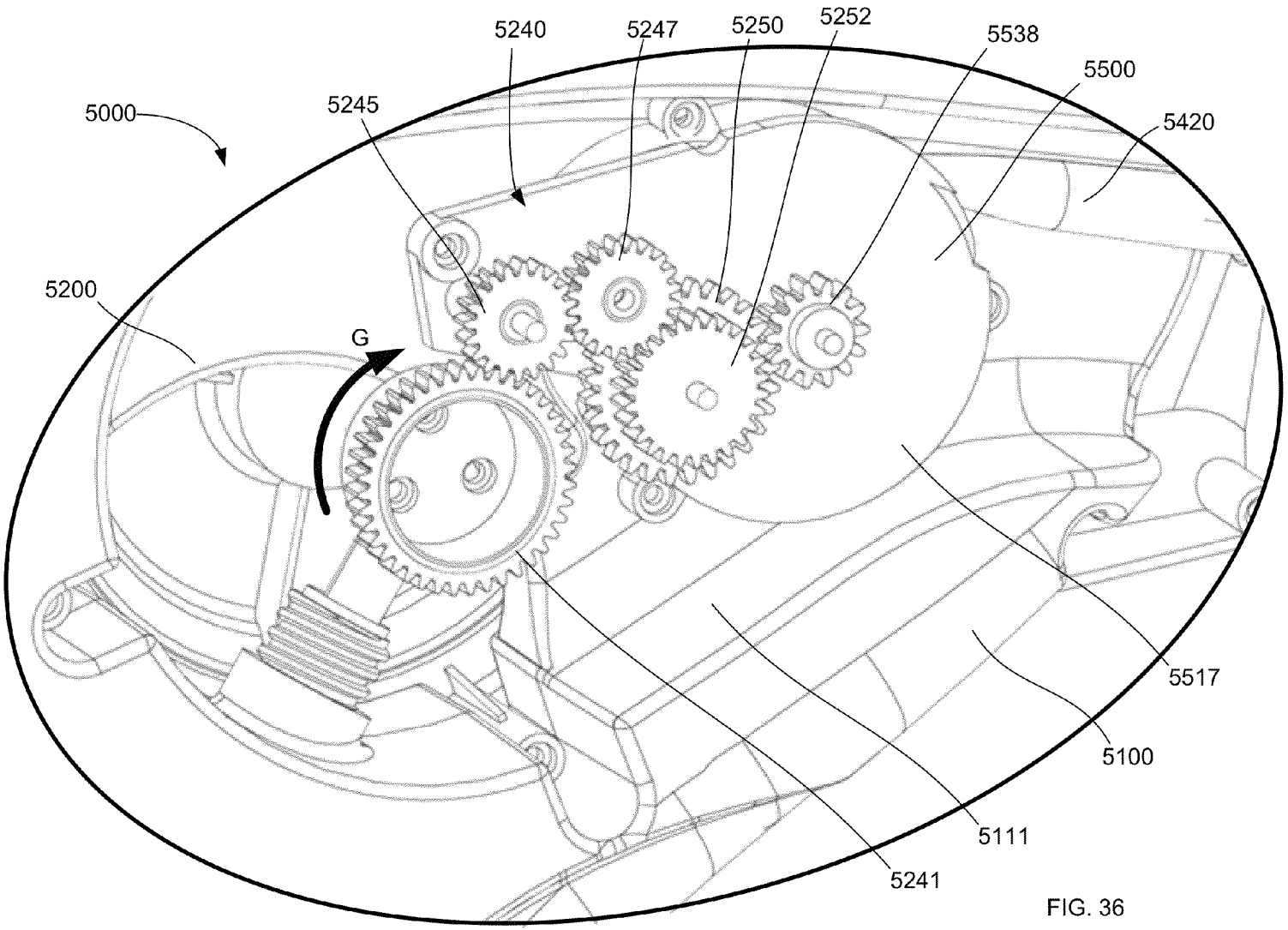
FIG. 36 is an enlarged view of a gear system represented by circle FIG. 36 in FIG. 35.

Referring to FIGS. 35 and 36, the internal chamber 5110 includes the recessed portion 5111 configured to provide room for the gear system 5240, the portion of the tube assembly 5400, and the pump assembly 5500. The tube assembly 5400 includes the PVC portion 5410 (shown in FIG. 34) and a flexible tube portion 5420, and can be substantially similar in form and function to the tube assembly 4400 described above with reference to the FIG. 17. In addition, the pump assembly 5500 can be substantially similar the pump assembly 4500 described above with respect to FIGS. 19-21. Thus, details of the tube assembly 5400 and the pump assembly 5500 are not described in further detail herein and should be considered substantially similar unless otherwise indicated.

The gear system 5420, as shown in FIG. 36, includes a drive gear 5241, a first kick-out gear 5245, a second kick-out gear 5247, a pump engagement gear 5250, a drive engagement gear 5252, and a pump gear 5538. The drive gear 5241 is configured to be coupled to the crank 5230 (shown in FIG. 35). The drive gear 5241, the first kick-out gear 5245, the second kick-out gear 5247, the pump engagement gear 5250, the drive engagement gear 5252, and/or the pump gear 5538 can have any suitable diameter such that the gear system 5240 has a predetermined gear ratio. For example, in some embodiments, the gear system 5240 can have a 1:9 gear ratio (e.g., the pump gear 5538 rotates nine times for every one rotation of the drive gear 5241). In other embodiments, the gear ratio can be any suitable ratio such as for example, 1:10, 1:11, 1:12, or any other ratio.

The pump assembly 5500 includes a pump cover 5517 that defines a kick-out gear slot through which the first kick-out gear 5245 slidably couples to the pump assembly 5500. As shown in FIG. 36, the drive engagement gear 5252 is disposed on top of the pump engagement gear 5250. In some embodiments, the drive engagement gear 5252 and the pump engagement gear 5250 are independent gears coupled together (e.g., integrally formed, fixedly coupled) in any suitable manner, such as, for example, a mechanical fastener, glue, and/or epoxy. In some embodiments, the drive engagement gear 5252 and the pump engagement gear 5250 are monolithically formed (e.g., a single cast or mold, and/or milled from a single piece of material). The pump gear 5538 extends from the cover 5517 and can be coupled to the pump assembly 5500 in any suitable fashion. For example, in some embodiments, the pump gear 5538 engages and/or is coupled to the pump assembly 5500 similar to the pump gear 4538, described above with reference to FIG. 20. In this manner, the pump assembly 5500 can function similarly to the pump assembly 4500 described above.

In use, the gear system 5240 is configured to transfer a rotational motion (produced by the user of the water gun 5000 turning the crank 5230) from the crank 5230 to the pump gear 5538, thereby activating the pump assembly 5500. More specifically, the gear system 5240 is configured to transfer a rotational motion in the direction of the arrow G to the pump gear 5538 such that the pump gear 5538 rotates in the direction of the arrow G. With the first kick-out gear 5245 disposed within the slot defined by the pump cover 5517, the gear system 5240 (and more specifically, the first kick-out gear 5245) can be configured such that a rotational motion in a direction opposite the arrow G slides the first kick-out gear 5245 within the slot of the pump cover 5517 and disengages the first kick-out gear 5245 from the second kick-out gear 5247. Similarly stated, the gear system 5240 is configured to only rotate a portion of the pump assembly 5500 in the direction of the arrow G. Thus, the pump assembly 5500 is configured to selectively engage a portion of the tube assembly 5400 to deliver a fluid to the outlet port 5600 and not from the outlet port 5600. In this manner, the pump assembly 5500 functions similarly to the pump assembly 4500 to engage the tube assembly 5400 such that a portion of a fluid is urged (e.g., pumped) through the tube assembly 5400 and out the outlet port 5600, as described herein with reference to FIGS. 22-27.

Although various embodiments have been described as having particular features and/or combinations of components, other embodiments are possible having any combination or sub-combination of any features and/or components from any of the embodiments described herein. The specific configurations of the various components can also be varied. For example, the size and specific shape of the various components can be different than the embodiments shown, while still providing the functions as described herein. Furthermore, each feature disclosed herein may be replaced by alternative features serving the same, equivalent or similar purpose, unless expressly stated otherwise. Thus, unless expressly stated otherwise, each feature disclosed is one example only of a generic series of equivalent or similar features.

Figure 29:
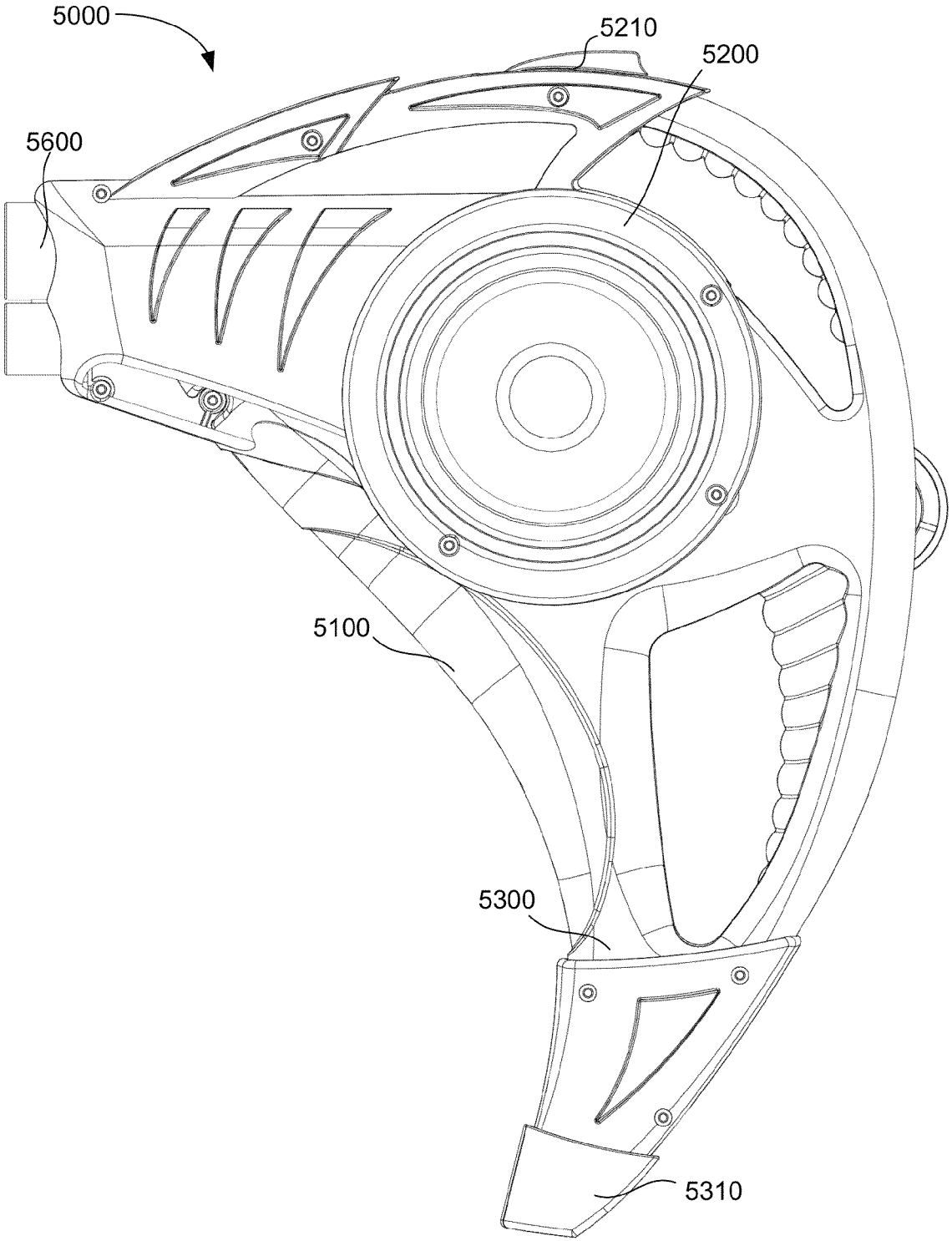
FIG. 29 is a left side view of the toy water gun of FIG. 28.
Figure 30:
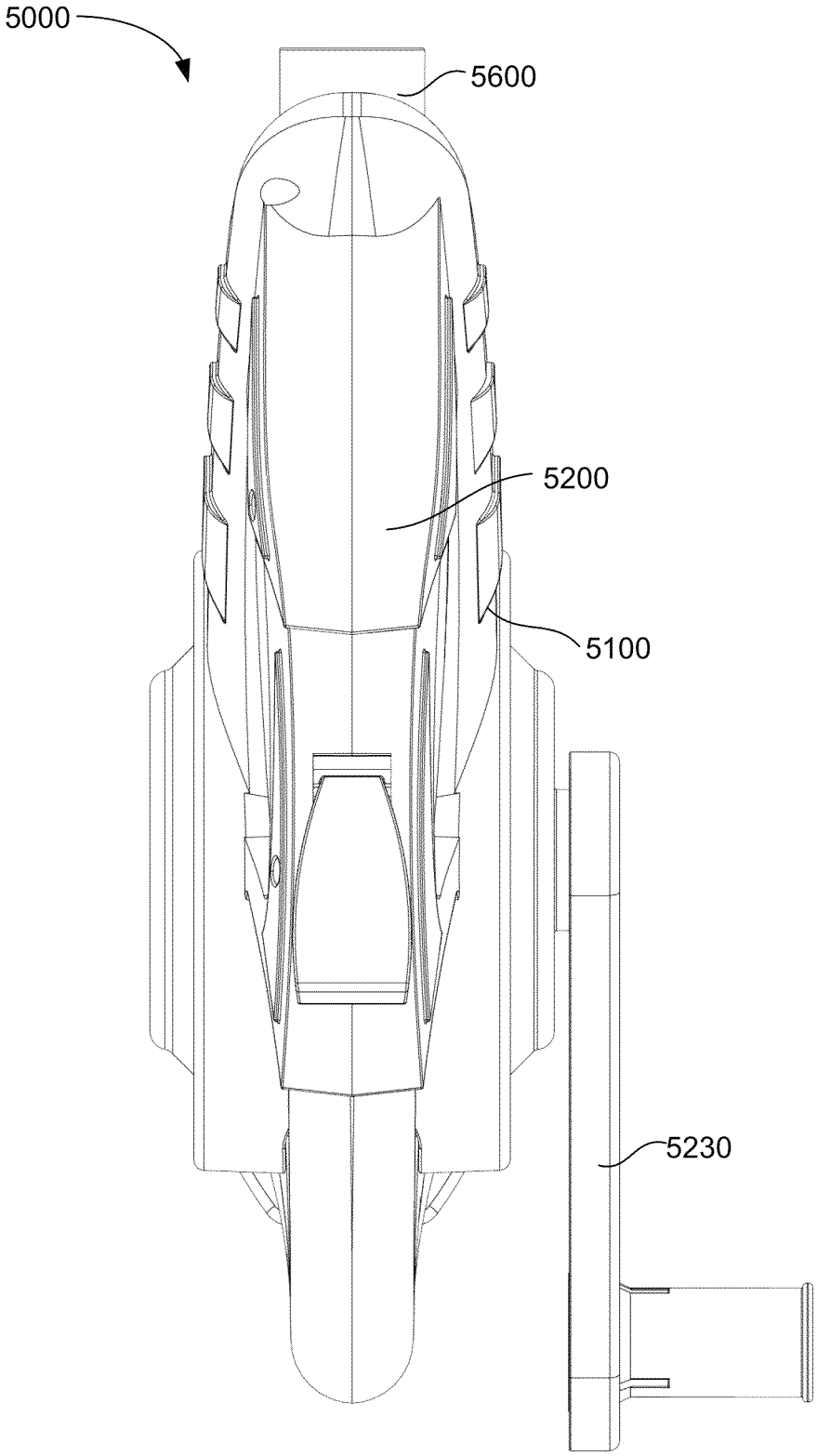
FIG. 30 is a top view of the toy water gun of FIG. 28.
Figure 31:
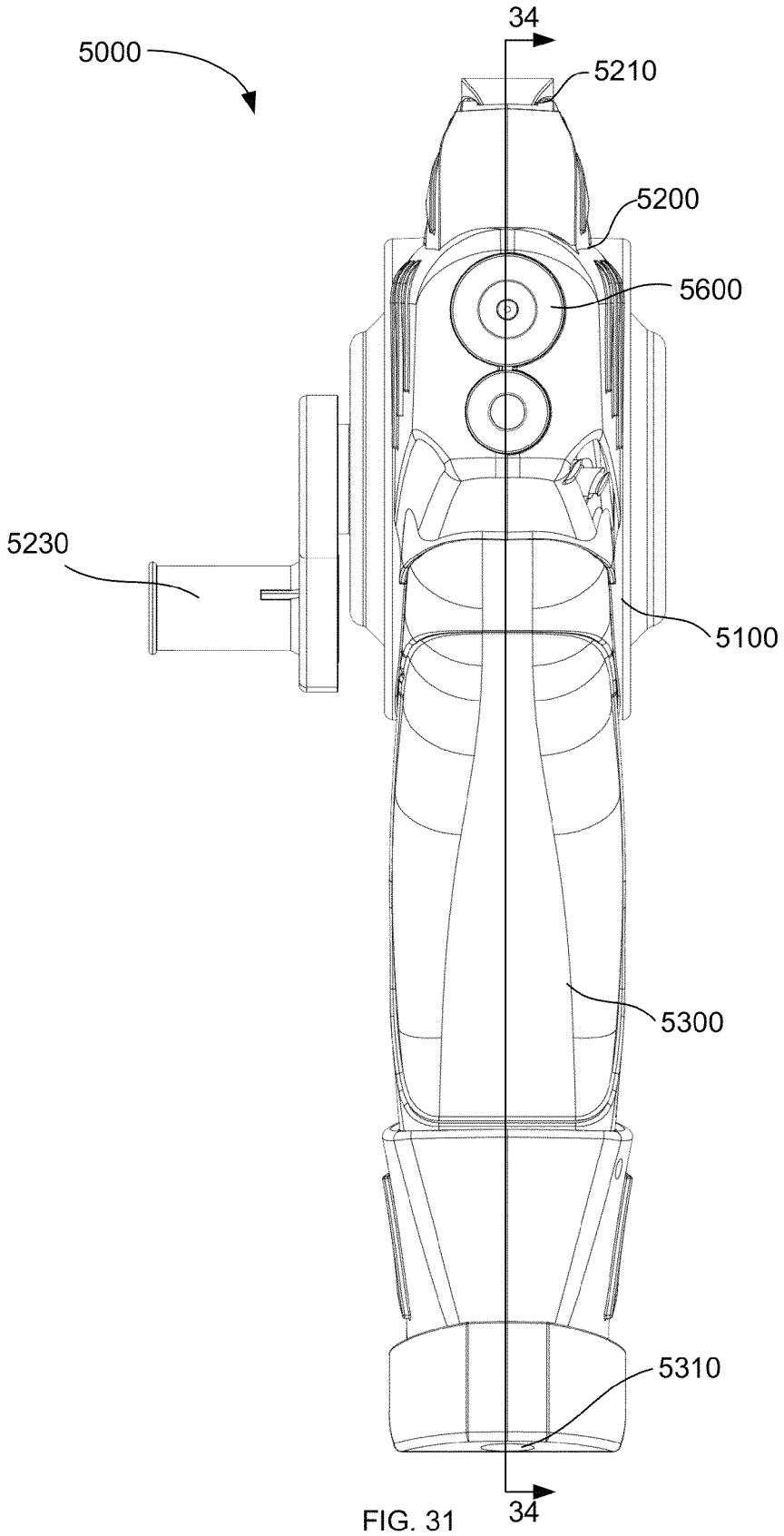
FIG. 31 is a front view of the toy water gun of FIG. 28.
Figure 32:
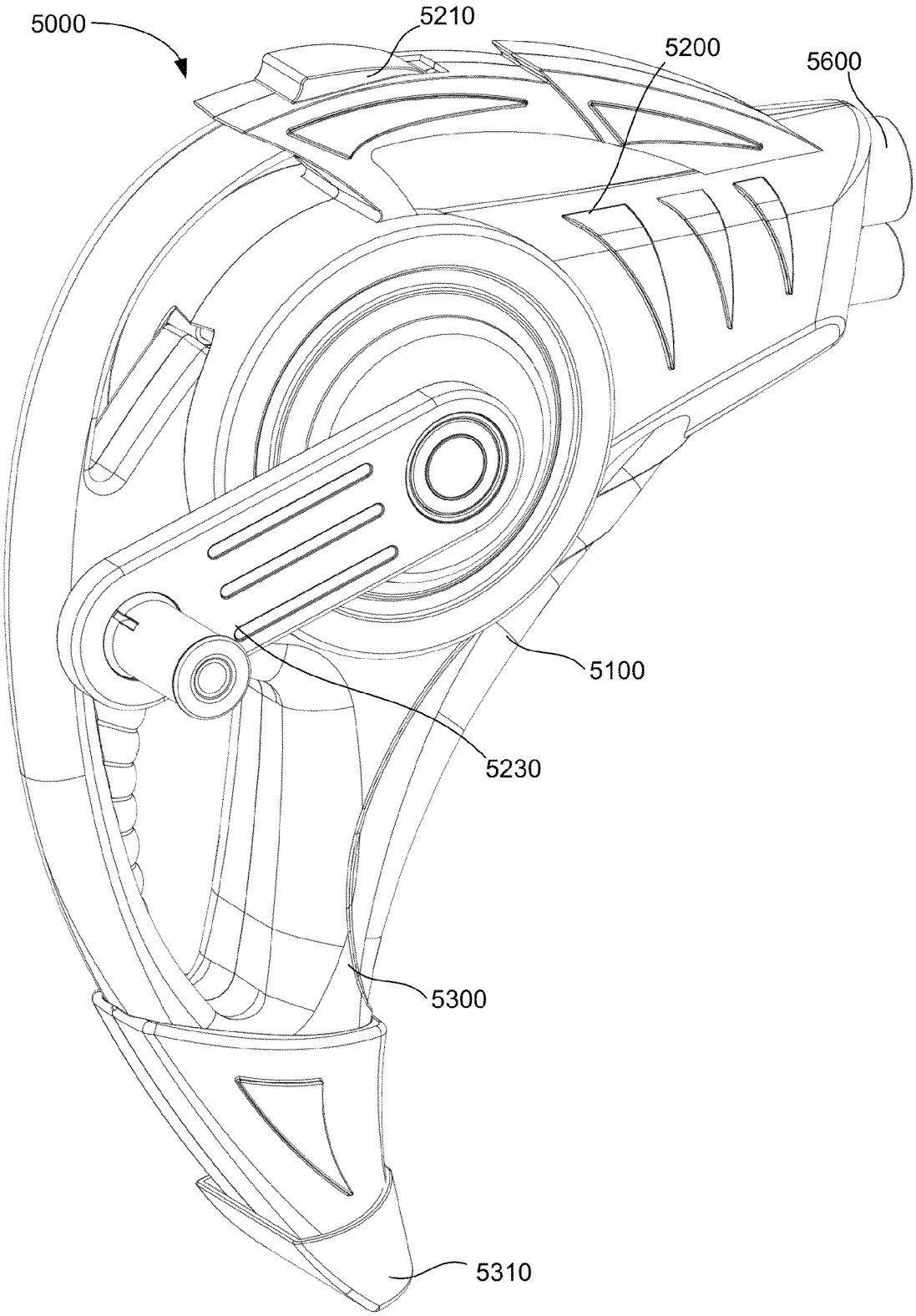
FIG. 32 is a perspective view of the toy water gun of FIG. 28.
Figure 37:
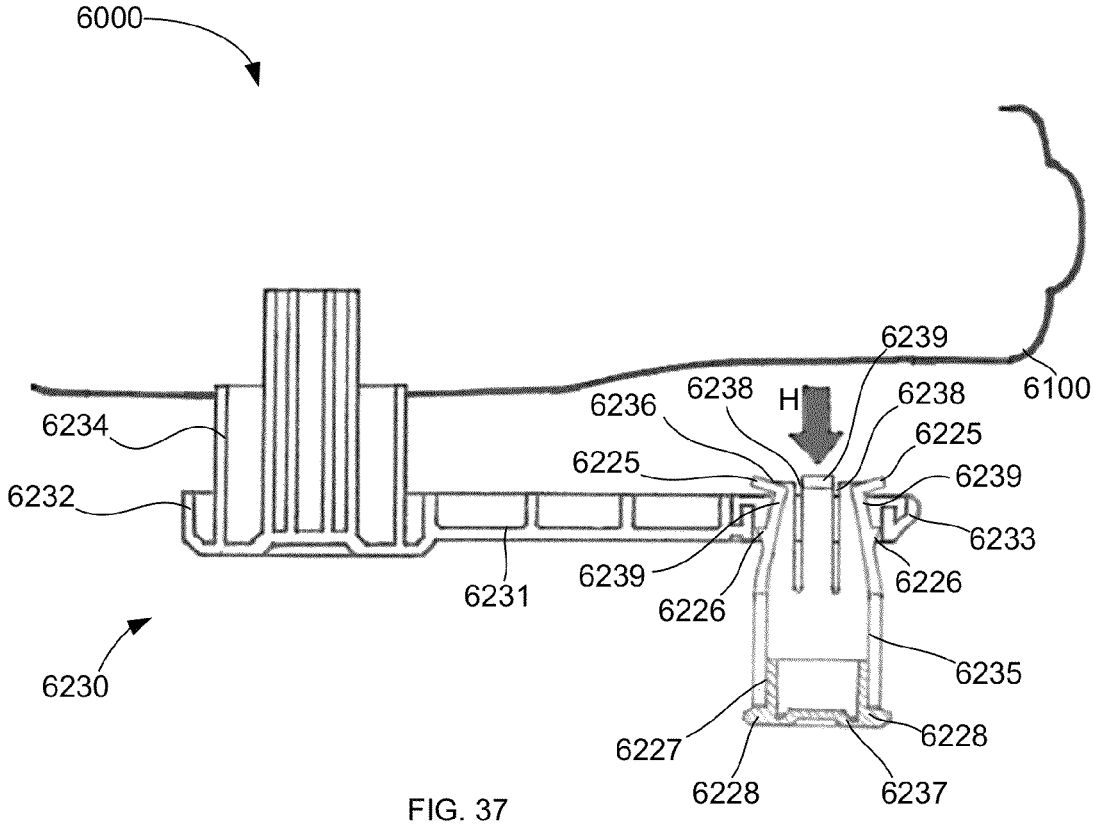
FIG. 37 is a cross-sectional view of a crank portion in a first configuration, according to an embodiment.
Figure 38:
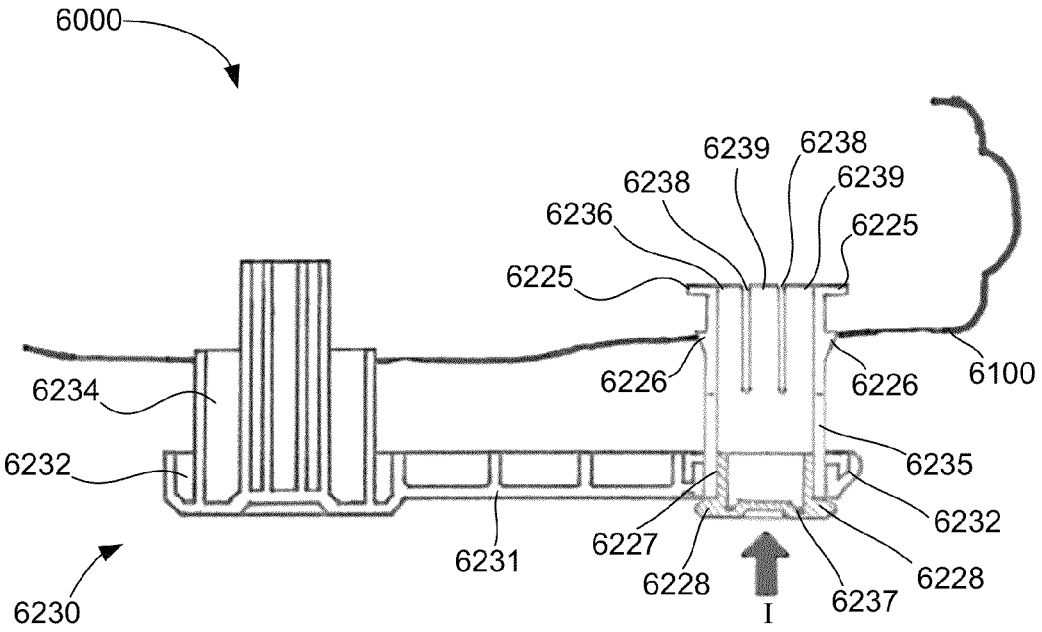
FIG. 38 is a cross sectional view of the crank portion of FIG. 28 in a second configuration.

For example, FIGS. 37 and 38 illustrate a portion of a water gun 6000, according to another embodiment. The water gun 6000 is substantially similar to the water gun 4000 in form and function except for a handle portion 6235 of the crank 6230 of the water gun 6000. In such an embodiment, a second end 66233 of a crank arm 66231 includes an aperture 6227 configured to receive the handle portion 6235. The handle portion 6235 includes a first end 6236 and a second end 6237, and moves between a first configuration and a second configuration. The first end 6236 of the handle 6235 includes any multiple of protrusions 6239 each having a flanged end 6225 and defining any multiple of slots 6238 therebetween. Additionally, the first end 6236 includes a set of tabs 6226. While in the first configuration, the first end 6236 is disposed within the aperture 6227 defined by the crank arm 6231 and, as such, the flanged ends 6225 of the protrusions 6239 and the tabs 6226 can engage the sides of the crank arm 6231 and removably secure the handle 6235 in an extended direction, indicated by the arrow H in FIG. 28. The second end 6237 of the handle 6235 includes a flange 6228. As shown in FIG. 29, the user of the water gun 6000 can apply a force in the direction of the arrow I and the handle 6235 can move within the aperture 6227 of the crank arm 6231 to the second configuration. The flanges 6228 included in the second end 6237 of the handle 6235 engage the side of the crank arm 6231 and prevent further movement in the direction of the arrow I beyond the second configuration. Thus, the water gun 6000 can be easily stored with a more compact/slim profile and without the handle catching other objects.

While various embodiments have been described above, it should be understood that they have been presented by way of example only, not limitation, and various changes in form and details may be made. For example, in reference to FIG. 7, while the upper intake port 4210 is shown in a given location, the upper inlet port 4210 can be disposed at any suitable position such that the upper intake port 4210 remains in fluid communication with the internal chamber 4110. Any portion of the apparatuses and/or methods described herein may be combined in any combination, except mutually exclusive combinations. Where methods and steps described above indicate certain events occurring in certain order, those of ordinary skill in the art having the benefit of this disclosure would recognize that the ordering of certain steps may be modified and that such modifications are in accordance with the variations of the invention. Additionally, certain of the steps may be performed concurrently in a parallel process when possible, as well as performed sequentially as described above.

What is claimed is:

1. An apparatus, comprising:

a housing defining an internal chamber, the housing having an outtake port, a first intake port and a second intake port that is fluidically coupled to the internal chamber; and a pump configured to transfer fluid from the first intake port to outside of the housing through the outtake port when the pump is activated and when the first intake port is disposed within an external fluid reservoir, the first intake port being configured to switch between a first position defining a fluid pathway between the internal chamber and the pump and a second position defining a fluid pathway between the external fluid reservoir and the pump.

2. The apparatus of claim 1, wherein:

the pump is configured to transfer fluid from the second intake port to outside of the housing through the outtake port when the pump is activated and when the second intake port is selected.

3. The apparatus of claim 1, wherein:

the housing has an upper portion and a lower portion, the first intake port being disposed in the lower portion of the housing, the second intake port being disposed in the upper portion of the housing, the housing is positionable such that the first intake port is disposed within the external fluid reservoir and the outtake port is disposed outside the external fluid reservoir.

4. The apparatus of claim 1, wherein:

the second intake port is configured to transfer fluid into the internal chamber, the first intake port having an opening, the first intake port configured to receive fluid from the internal chamber through the opening when the first intake port is in the first position, the first intake port configured to receive fluid from the external fluid reservoir through the opening when the first intake port is in the second position.

5. The apparatus of claim 1, wherein:

the first intake port having a first configuration and a second configuration, the pump is fluidically coupled to the internal chamber and not an external reservoir when the first intake port is in the first configuration, the pump is configured to transfer fluid, from the external fluid reservoir and not the internal chamber, to outside of the housing through the first intake port and the outtake port when the pump is activated and when the first intake port is in the second configuration.

6. The apparatus of claim 1, wherein:

the pump is a peristaltic pump having a tube, the tube having a first end and a second end opposite the first end, the first end of the tube being fluidically coupled to the first intake port, the second end of the tube being fluidically coupled to the outtake port.

7. An apparatus, comprising:

a housing defining an internal chamber, the housing having an outtake port, a first intake port and a second intake port that is fluidically coupled to the internal chamber; and a pump configured to transfer fluid from the first intake port to outside of the housing through the outtake port when the pump is activated and when the first intake port is disposed within an external fluid reservoir, the second intake port is configured to transfer fluid into the internal chamber, the first intake port having a one-way valve and an opening, the first intake port configured to receive fluid through the opening from the internal chamber or the external fluid reservoir, the one-way valve of the first intake port configured to receive fluid from the opening in a first direction and prevent fluid being sent to the opening in a second direction opposite the first direction.

8. An apparatus, comprising:

a housing defining an internal chamber, an outtake port and an intake port having a first configuration and a second configuration; and a pump configured to transfer fluid from the internal chamber to outside of the housing through the outtake port without transferring fluid from an external fluid reservoir when the pump is activated and when the intake port is in the first configuration, the pump configured to transfer fluid from the external fluid reservoir to outside the housing through the intake port and the outtake port when the pump is activated and when the intake port is in the second configuration.

9. The apparatus of claim 8, wherein:

the housing is positionable such that the intake port is disposed within the external fluid reservoir and the outtake port is disposed outside the external fluid reservoir.

10. The apparatus of claim 8, wherein:

the housing has an upper portion and a lower portion, the intake port is a lower intake port disposed in the lower portion of the housing, the housing defining an upper intake port disposed in the upper portion of the housing.

11. The apparatus of claim 8, wherein:

the housing has an upper portion and a lower portion, the intake port is a lower intake port disposed in the lower portion of the housing, the housing is positionable such that the lower intake port is disposed within the external fluid reservoir and the outtake port is disposed outside the external fluid reservoir the housing defining an upper intake port disposed in the upper portion of the housing, the upper intake port configured to transfer a fluid to the internal chamber when the upper intake port is disposed above the lower intake port and the upper intake port receives the fluid.

12. The apparatus of claim 8, wherein:

the pump is a peristaltic pump having a tube, the tube having a first end and a second end opposite the first end, the first end of the tube being fluidically coupled to the intake port, the second end of the tube being fluidically coupled to the outtake port.

13. The apparatus of claim 8, wherein:

the lower intake port having a one-way valve and an opening, the lower intake port configured to receive fluid through the opening from the internal chamber or the external fluid reservoir, the one-way valve of the lower intake port configured to receive fluid from the opening in a first direction and prevent fluid being sent to the opening in a second direction opposite the first direction.

14. The apparatus of claim 8, wherein:

the pump is a peristaltic pump;

the peristaltic pump configured to transfer fluid from the external fluid reservoir to outside the housing continuously without a break in a fluid stream when the peristaltic pump is activated continuously.

15. An apparatus, comprising:

a housing defining an internal chamber, an outtake port and an intake port having a one-way valve; and a peristaltic pump having an tube fluidically coupled to the intake port, the peristaltic pump configured to transfer fluid from the internal chamber to outside of the housing through the outtake port and the one-way valve of the intake port without transferring fluid from an external fluid reservoir when the peristaltic pump is activated, the peristaltic pump configured to transfer fluid from the external fluid reservoir to outside the housing through the outtake port and the one-way valve of the intake valve without transferring fluid from the internal chamber when the peristaltic pump is activated.

16. The apparatus of claim 15, wherein:

the intake port has a first configuration and a second configuration, the intake port fluidically couples the internal chamber to the intake tube of the peristaltic pump when the intake port is in the first configuration, the intake portion fluidically couples the external fluid reservoir to the intake tube of the peristaltic pump when the intake port is in the second configuration.

17. The apparatus of claim 15, wherein:

the tube is a first end and a second end opposite the first end, the first end of the tube being fluidically coupled to the intake port, the second end of the tube being fluidically coupled to the outtake port.

18. The apparatus of claim 15, wherein:

the housing is positionable such that the intake port is disposed within the external fluid reservoir and the outtake port is disposed outside the external fluid reservoir.

19. The apparatus of claim 15, wherein:

the lower intake port has an opening, the lower intake port configured to receive fluid through the opening from the internal chamber or the external fluid reservoir, the one-way valve of the lower intake port configured to receive fluid from the opening in a first direction and prevent fluid being sent to the opening in a second direction opposite the first direction.

20. The apparatus of claim 15, wherein:

the peristaltic pump configured to transfer fluid from the external fluid reservoir to outside the housing continuously without a break in a fluid stream when the peristaltic pump is activated continuously.

* * * * *